US007418802B2

(12) United States Patent
Sarine et al.

(10) Patent No.: US 7,418,802 B2
(45) Date of Patent: Sep. 2, 2008

(54) EXPANDABLE SHELTER SYSTEM

(75) Inventors: Scott Sarine, York, PA (US); Richard Smith, Seven Valley, PA (US); Thomas Anderson, York, PA (US)

(73) Assignee: Gichner Systems Group, Inc., Dallastown, PA (US)

( * ) Notice: Subject to any disclaimer, the term of this patent is extended or adjusted under 35 U.S.C. 154(b) by 70 days.

(21) Appl. No.: 11/223,813

(22) Filed: Sep. 9, 2005

(65) Prior Publication Data

US 2007/0079573 A1 Apr. 12, 2007

(51) Int. Cl.
*E04H 1/00* (2006.01)

(52) U.S. Cl. ..... 52/79.5; 52/79.1; 52/79.7

(58) Field of Classification Search ..... 52/592.1, 52/79.5, 79.1, 79.7, 79.6, 67
See application file for complete search history.

(56) References Cited

U.S. PATENT DOCUMENTS 3,107,116 A * 10/1963 Meaker ..... 296/171
3,653,165 A * 4/1972 West ..... 52/67
3,966,285 A 6/1976 Porch et al.
4,235,346 A 11/1980 Liggett
4,546,578 A * 10/1985 Behrmann ..... 52/67
4,603,518 A * 8/1986 Fennes ..... 52/66
4,726,158 A 2/1988 Fagnoni
4,854,094 A 8/1989 Clark
5,586,802 A 12/1996 Dewald, Jr. et al.
5,658,032 A * 8/1997 Gardner ..... 296/26.01
5,778,618 A 7/1998 Abrams
5,815,988 A 10/1998 Molina
5,916,096 A 6/1999 Wiesmann et al.
5,966,956 A * 10/1999 Morris et al. ..... 62/259.1
2004/0262948 A1 12/2004 Parmer

OTHER PUBLICATIONS

Product brochure for Euro Light—Variable Room Modules by M. Schall GambH & Co., Germany, www.mchall.com, 2 pages.
Product brochure for Sandwich-Body-Constructions on Daimler Chrysler, G-Waggon vehicles, by M. Schall GambH & Co., Germany, www.mchall.com, 2 pages.
Product brochure for Body-Constructions for Mobile Operating-Stations by M. Schall GambH & Co., Germany, www.mchall.com, 2 pages.

(Continued)

*Primary Examiner*—Basil Katcheves
(74) *Attorney, Agent, or Firm*—Thomas J. Perkowski, Esq., P.C.

(57) ABSTRACT

A side expandable shelter system having a transport mode in which a side expandable section(s) is completely nested within an (ISO-style) main shelter section, and a deployment mode in which the side expandable section is completely protracted from the main shelter section. The side expandable shelter system comprises a flooring structure for the side expandable section provided by a hinged flooring panel assembly consisting of at least two floor panels hinged together so that they can be stacked compactly in a vertical direction when the side expandable section is retracted within the main shelter section, in a nested manner, so as to be completed contained therewithin its transport mode, and extended in horizontal direction when the side expandable section is projected from the main shelter section during the deployment mode. Both single and double side expandable shelter systems are provided.

25 Claims, 42 Drawing Sheets

OTHER PUBLICATIONS

Product brochure for Shelters and Cabins for Mobile Operating-Stations by M. Schall GambH & Co., Germany, www.mchall.com, 2 pages.

Product brochure for Multifunctional-Container (MuFuCo) by M. Schall GambH & Co., Germany, www.mchall.com, 2 pages.

Product brochure for Schall-Container-Systems SCS Expandable according to ISO standard or as Rolling-Off Container according to DIN 14505 by M. Schall GambH & Co., Germany, www.mchall.com, 2 pages.

Product brochure for Containers according to ISO-standard, to be used at Mobile Operating-Stations by M. Schall GambH & Co., Germany, www.mchall.com, 2 pages.

Product brochure for Mobile Operating-Stations in Sandwich-Construction as Basic Module for International Used Systems by M. Schall GambH & Co., Germany, www.mchall.com, 2 pages.

* cited by examiner

1

EXPANDABLE SHELTER SYSTEM

BACKGROUND OF INVENTION

1. Field of Invention

The present invention is directed to improvements in expandable shelter systems which can house diverse kinds of equipment (e.g. electronics, medical instruments, etc) for transport on conventional cargo systems and carrier vehicles to remote locations for rapid deployment.

2. Brief Description of the State of Knowledge in the Art

Expandable ISO shelters for containing preconfigured electronic systems (e.g. command, control and communications C3 systems), as well as providing mobile field hospitals (i.e. medical treatment centers) are well known in the art.

Examples of such expandable shelter systems are disclosed in U.S. Pat. No. 5,815,988 to Molina; U.S. Pat. No. 5,658,032 to Gardner; U.S. Pat. No. 5,586,802 to Dewald, Jr. et al.; U.S. Pat. No. 4,546,578 to Behrmann; U.S. Pat. No. 4,854,094 to Clark; U.S. Pat. No. 4,603,518 to Fennes; and U.S. Pat. No. 3,107,116 to Meaker.

Examples of commercially available expandable shelters are offered by M. Schall GmbH & Co. KG, Germany, under the following product designation: Schall-Container-Systems Expandable SCS [1:2/1:3] for mobile command post applications, constructed according to ISO Standard or as a rolling-off container according to DIN 14505.

As described in its product brochures, the central part of the Expandable SCS is made of insulated and galvanized steel construction, and the expandable boxes are made from an insulated sandwich construction, with aluminum fittings. The heavy-weight version of the Expandable SCS is 9-times stackable, whereas the lightweight version of the unit is 4-times stackable. During its operating/deployment condition, the floors of the Expandable SCS are on the same level. The Expandable SCS is designed for various rapid and long-term applications, for operation on a carrier vehicle or on the ground. The expandable sections of the Expandable SCS are designed as closed boxes for an optimal overpressure tightness of the complete system. Due to its modular construction, he containers of the Expandable SCS can be adapted to the required application at hand and provided with doors, service cut outs, partition walls, etc. as required.

While the Expandable SCS offers many features and does suffer from a number of shortcomings and drawbacks.

In particular, the expandable sections of the Expandable SCS are realized as self-contained boxes with rigid flooring structures that nest within the central or main section of the Expandable SCS. In the single side expandable version of the SCS, the expandable box nests within the central section of the Expandable SCS. In the double side expandable version of the Expandable SCS, the expandable boxes nest within each other, and this sub-combination of boxes then nets within the central section of the Expandable SCS. Due to this prior art design, the Expandable SCS during its deployment/operating mode or condition, requires that the expandable boxes are automatically lowered to the same floor level as the central part (i.e. with no steps) using a leveling support system, which adds complexity and cost to the system design, and also provides an additional point of failure.

Furthermore, this prior art box nesting design of the expandable sections of the Expandable SCS prevents permanent mounting of equipment on the floor of the central section of the SCS during its transport mode. Consequently, equipment designated for installation on the floor of the central section of the Expandable SCS during the deployment mode, must be stored elsewhere within the central section of the Expandable SCS and then redeployed to the floor of the central station after the expandable section(s) have been moved to the deployment positions.

Another consequence of the prior art design employed by the Expandable SCS is that the expandable sections cannot be made to be substantially the same volume of the central section of the shelter system, maximizing on the expandability in volume of prior art shelter systems. This results in a non-optimal use of interior space with the expandable shelter system, and requires movement of (typically sensitive) equipment with the shelter system after deployment in the field, which is highly undesirable in demanding applications such as mobile C3 applications, and mobile field hospital applications.

Thus there is a great need in the art for an improved expandable shelter system that is free from the shortcomings and drawbacks of prior art shelter system designs.

SUMMARY AND OBJECTS OF THE PRESENT INVENTION

Accordingly, it is a primary object of the present invention to provide an improved expandable shelter system which is free from the many shortcomings and drawbacks associated with prior art expandable shelter systems.

Another object of the present invention is to provide an expandable shelter system that provides for rapid deployment and expansion in diverse environments.

Another object of the present invention is to provide such an expandable single-side expandable shelter system which provides the added floor space needed for Command, Control and Communications (C3) systems requiring extensive rack-mounted information servers, signal processing equipment, data storage devices, and the like.

Another object of the present invention is to provide such an expandable shelter system which, when its single side expandable section is expanded, provides almost 25 square meters of operational floor space.

Another object of the present invention is to provide such an expandable shelter system which when closed, meets the dimensional requirements of ISO 668 and ANSI MH5.4 allowing for transport using all common intermodal transport methods.

Another object of the present invention is to provide such an expandable shelter system which due to its unique design, can be easily modified to permit over pressurization for NBC protection for the enclosed system and personnel.

Another object of the present invention is to provide such an expandable shelter system, wherein a single expandable side section nests inside a main 20-foot ISO shelter section during transport.

Another object of the present invention is to provide such an expandable shelter system, wherein equipment can be permanently mounted on the floor of the central section of the expandable shelter system.

Another object of the present invention is to provide such an expandable shelter system, wherein the floor panel of the single expandable side section is hinged longitudinally, allowing the floor section to fold in half when the shelter is closed for transport, thereby providing for temporary or permanent mounting of heavy equipment to the floor of the main shelter section.

Another object of the present invention is to provide such an expandable shelter system, wherein the flush floor design allows easy relocation of equipment into the expandable section for operation.

Another object of the present invention is to provide such an expandable shelter system, wherein its unique folding floor design allows for permanent mounting of equipment on the upper half of the walls of the expandable side section, thereby reducing the need to move that equipment after deployment.

Another object of the present invention is to provide an expandable shelter system, wherein electronic equipment may be permanently mounted to the upper half of the expandable side section's three walls, thereby allowing for permanent interconnection of this equipment.

Another object of the present invention is to provide a double-side expandable shelter system which, when both of its expandable side sections are expanded, provides almost 35.4 square meters of operational floor space.

Another object of the present invention is to provide such an expandable shelter system which when closed, meets the dimensional requirements of ISO 668 and ANSI MH5.4 allowing for transport using all common intermodal transport methods.

Another object of the present invention is to provide such an expandable shelter system which due to its unique design, can be easily modified to permit over pressurization for NBC protection for the enclosed system and personnel.

Another object of the present invention is to provide such an expandable shelter system, wherein its set of double expandable side sections nest inside a main 20-foot ISO shelter section during transport.

Another object of the present invention is to provide such an expandable shelter system, wherein the floor panel of each expandable side section is hinged longitudinally, allowing the floor section to fold in half when the shelter is closed for transport, thereby providing for temporary or permanent mounting of heavy equipment to the floor of the main ISO shelter section.

Another object of the present invention is to provide such an expandable shelter system, wherein the flush floor design allows easy relocation of equipment into the expandable section for operation.

Another object of the present invention is to provide such an expandable shelter system, wherein its unique folding floor design, in each expandable side section, allows for permanent mounting of equipment on the upper half of the walls of the expandable side section, thereby reducing the need to move that equipment after deployment.

Another object of the present invention is to provide an expandable shelter system, wherein electronic equipment may be permanently mounted to the upper half of the expandable side section's three walls, thereby allowing for permanent interconnection of this equipment.

Another object of the present invention is to provide an expandable shelter system, wherein lighting, power distribution, and signal distribution apparatus can be permanently installed in both the main section and the expandable side section of the shelter system.

Another object of the present invention is to provide an expandable shelter system, wherein due to its modular design, custom configurations including different length expandable sections can be manufactured to suit specific system needs.

Another object of the present invention is to provide an expandable shelter system, wherein interior partitions can be installed within the shelter system to create a separate externally accessible equipment room, if desired.

Another object of the present invention is to provide an expandable shelter system, wherein the weight of a single-side expandable shelter system is less than 2364 Kg (5200 pounds), and wherein the weight of its payload can be at least 6727 Kg (14,800 pounds).

Another object of the present invention is to provide an expandable shelter system, wherein the floor load, at the center section of the shelter system can be at least 522 Kg/m$^2$ uniform load over the entire floor (107 pounds/ft$^2$).

Another object of the present invention is to provide an expandable shelter system, wherein its payload on the expandable section can be at least 910 Kg (2000 pounds).

Another object of the present invention is to provide an expandable shelter system, wherein the roof load at the center section can be at least 366 Kg/m$^2$ uniform load over the entire roof (75 pounds /ft$^2$).

Another object of the present invention is to provide an expandable shelter system, wherein the roof load at the expandable section can be at least 195 Kg/M$^2$ uniform load over the entire roof (40 pounds /ft$^2$).

Another object of the present invention is to provide an expandable shelter system, which can withstand temperature extremes during operational modes in the range of −54° C. to 52° C. (−65° F. to 125° F.), and during non-operational modes in the range of −62° C. to 71° C. (−80° F. to 160° F.).

Another object of the present invention is to provide an expandable shelter system, wherein M8 Rivnuts® installed in members of its center section, can withstand wall attachment loading of at least 910 Kg (2000 pounds) tensile loads.

Another object of the present invention is to provide an expandable shelter system, wherein potted Inserts installed anywhere within the expandable side section can withstand at least 455 Kg (1000 pounds) tensile loads.

Another object of the present invention is to provide an expandable shelter system, which can be docked together to form larger functional units.

Another object of the present invention is to provide an expandable shelter system, wherein double gaskets provided at all seams provide water-tightness for protection against wind-driven rain.

Another object of the present invention is to provide an expandable shelter system, wherein full-length replaceable skids are provided on the underside of the main section of the expandable shelter system.

Another object of the present invention is to provide an expandable shelter system, wherein three roof access folding steps are mounted on each expandable sidewall section, along with one roof handhold.

Another object of the present invention is to provide an expandable shelter system, wherein an air-conditioning unit is mounted on the main section of the expandable shelter system to condition air therewithin during is deployment mode.

Another object of the present invention is to provide an expandable shelter system, wherein gas impervious seals are provided at each and every joint to prevent dangerous gases and other microbial agents from entering the interior of the expandable shelter system.

Another object of the present invention is to provide an expandable shelter system, which is EMC/EMP protected.

Another object of the present invention is to provide an electronic command, control and communications (C3) center that is housed within an ISO-style expandable shelter system having the features and functionalities described above.

These and other objects of the present invention will become more apparently understood hereinafter and in the Claims to Invention appended hereto.

BRIEF DESCRIPTION OF THE DRAWINGS

For a more complete understanding of how to practice the Objects of the Present Invention, the following Detailed Description of the Illustrative Embodiments should be read in conjunction with the accompanying Drawings, briefly described below, wherein.

DETAILED DESCRIPTION OF THE ILLUSTRATIVE EMBODIMENTS OF THE PRESENT INVENTION

Figure 1:
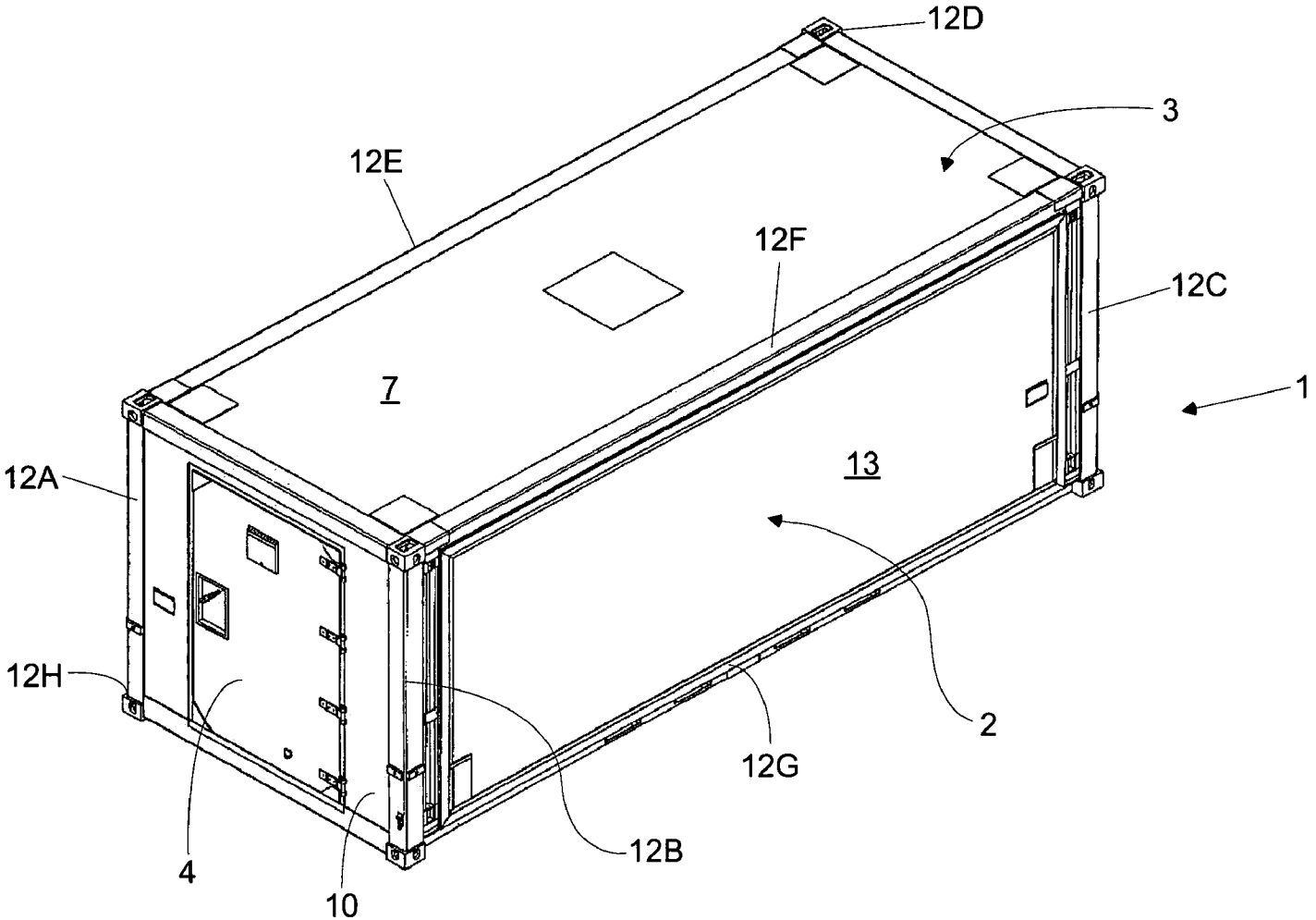
FIG. 1 is a first perspective view of the single-side expandable shelter system of the present invention arranged in its transport mode/configuration without interior equipment mounted therein, and showing its expandable section nested inside the main shelter section and its side door arranged in its closed configuration during transport.
Figure 2:
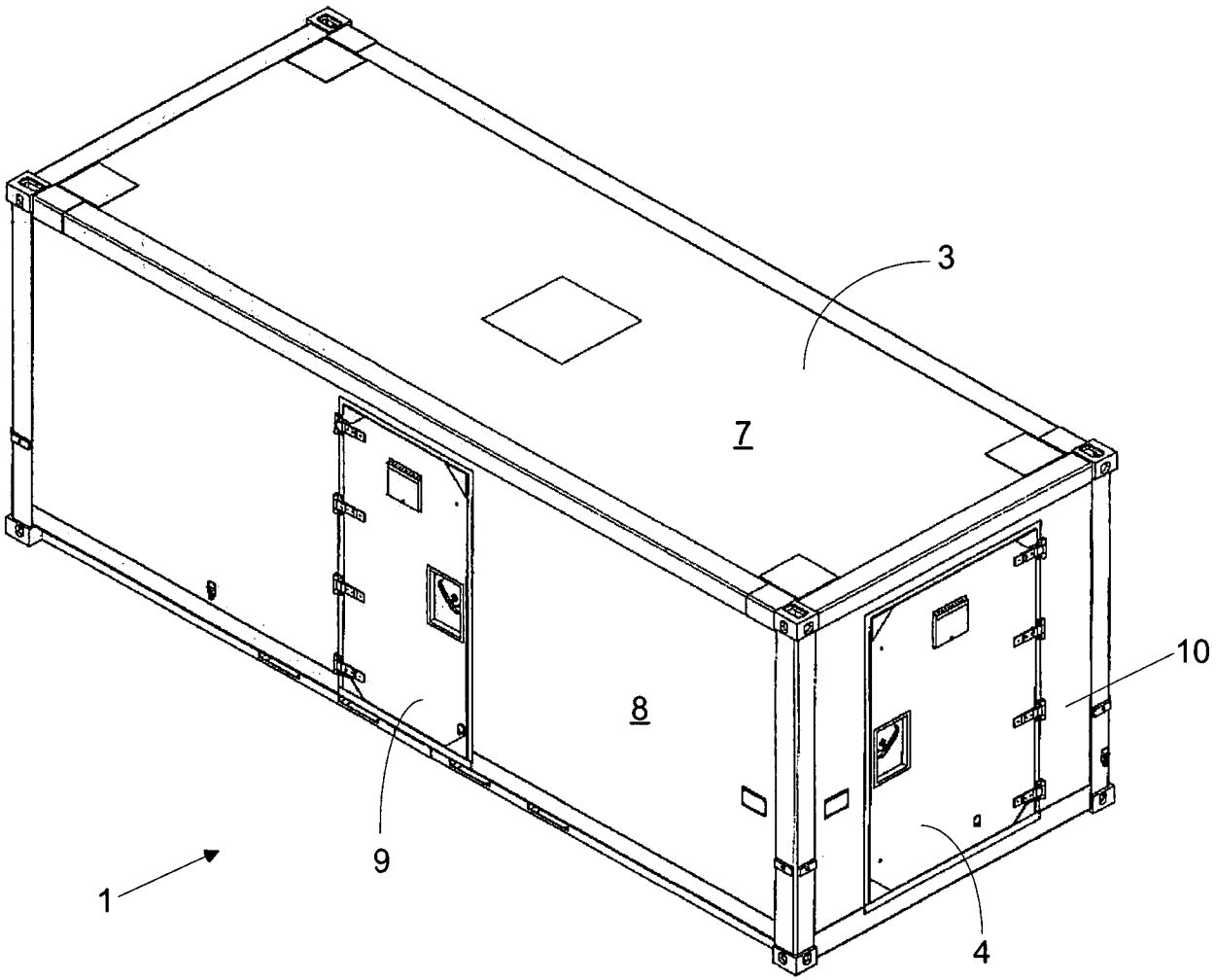
FIG. 2 is a second perspective view of the single-side expandable shelter system of the present invention arranged in its transport configuration without interior equipment mounted therein, and showing both its front and side doors arranged in a closed configuration during transport.
Figure 3:
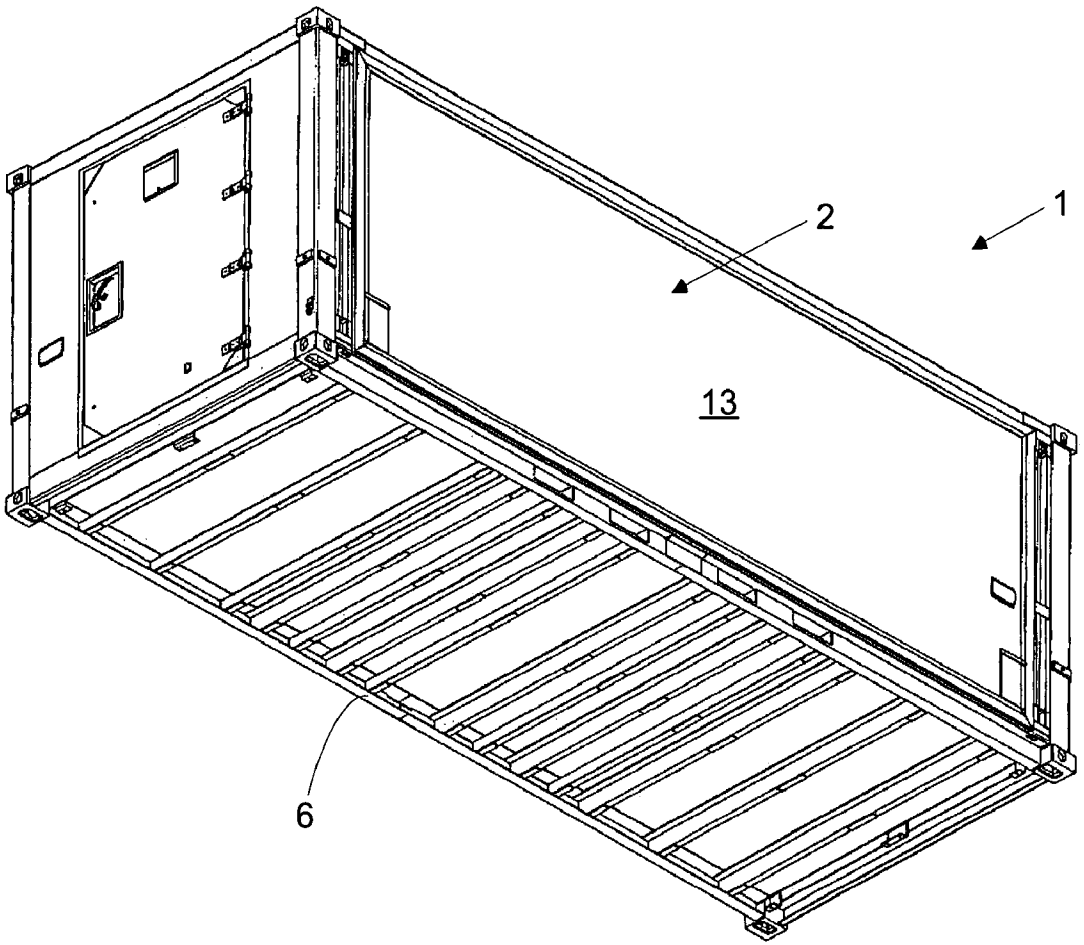
FIG. 3 is a third perspective view of the single-side expandable shelter system of the present invention arranged in its transport configuration without interior, equipment mounting therein, showing a replaceable full-length skid structure affixed to the bottom of the main shelter section and the side door of the shelter system arranged in its closed configuration.
Figure 4A:
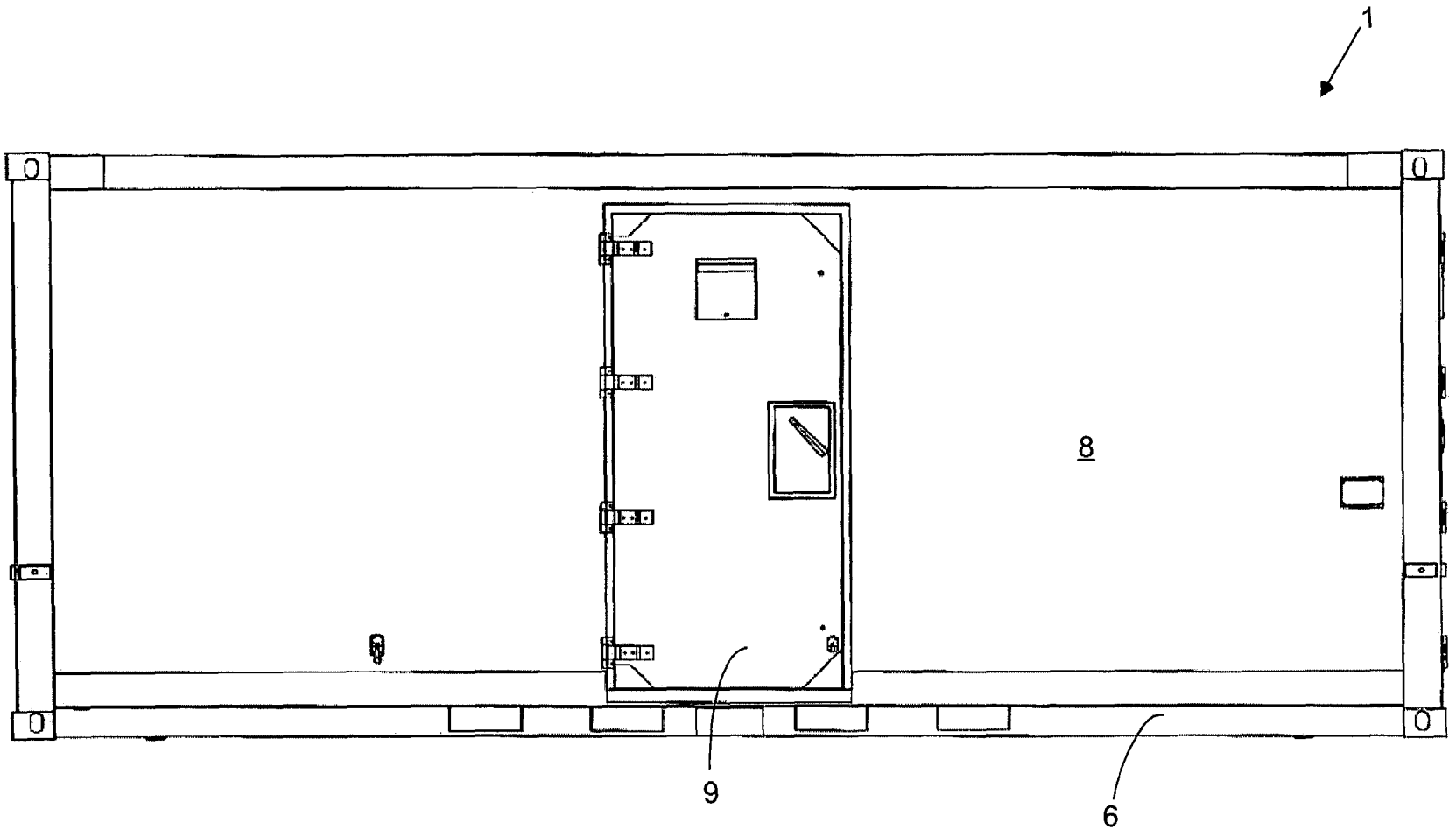
FIG. 4 is a side view of the exterior of the single-side expandable shelter system of the present invention arranged in its transport configuration without interior equipment mounted therein, and showing the front door of the shelter system arranged in its closed configuration.
Figure 4B:
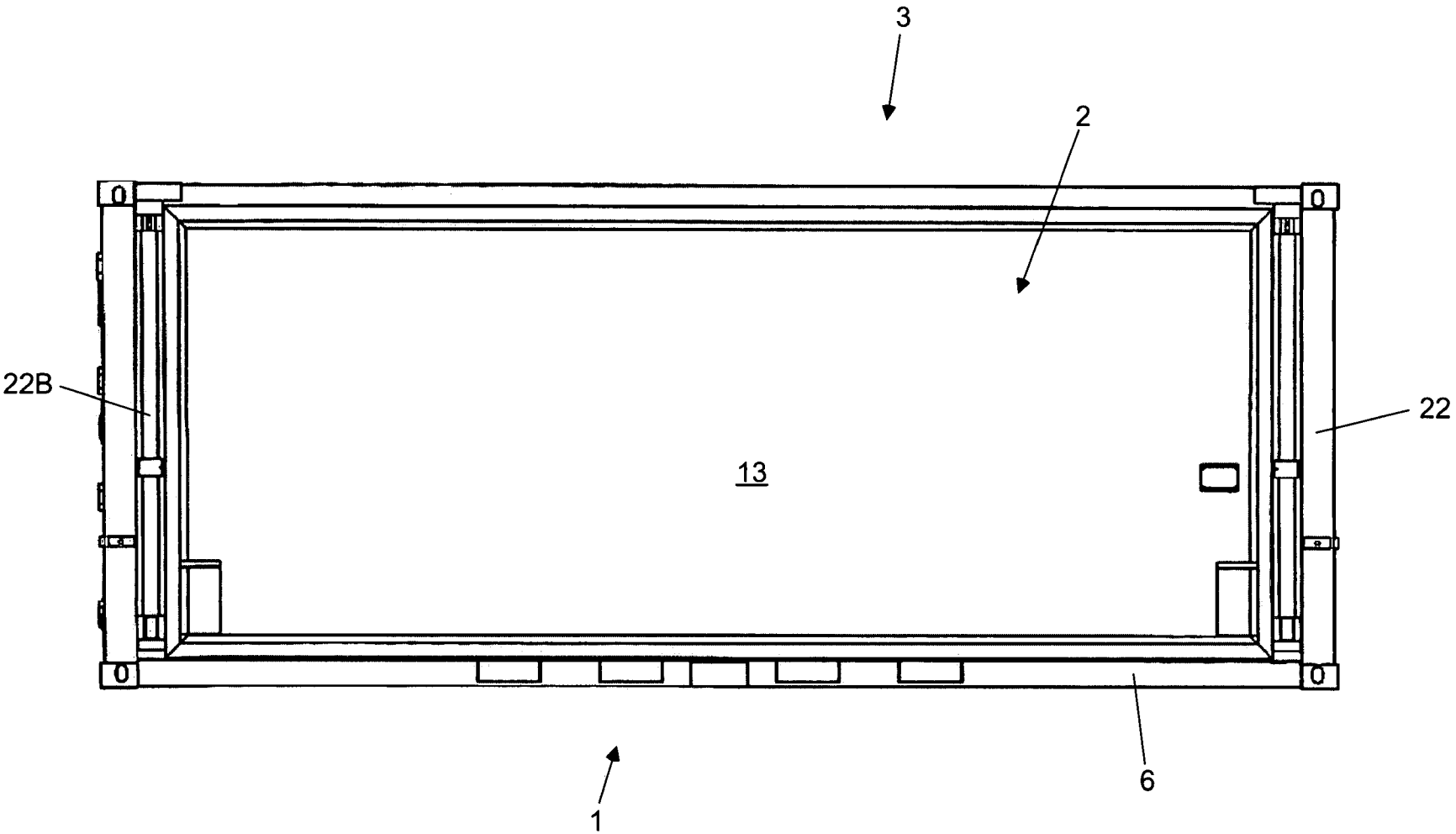
Figure 5:
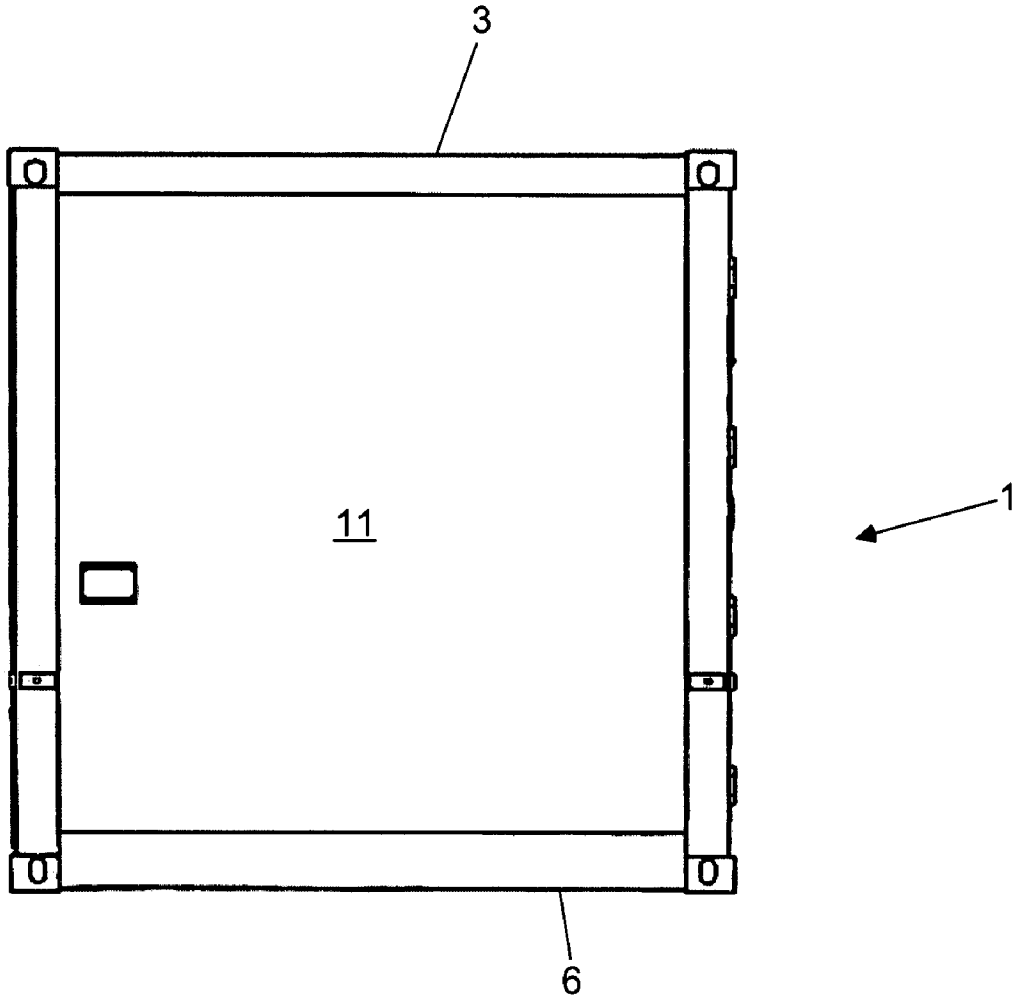
FIG. 5 is a sectional view of the single-side expandable shelter system of the present invention arranged in its transport configuration without interior equipment mounted therein, taken along line C-C of FIG. 4.
Figure 6:
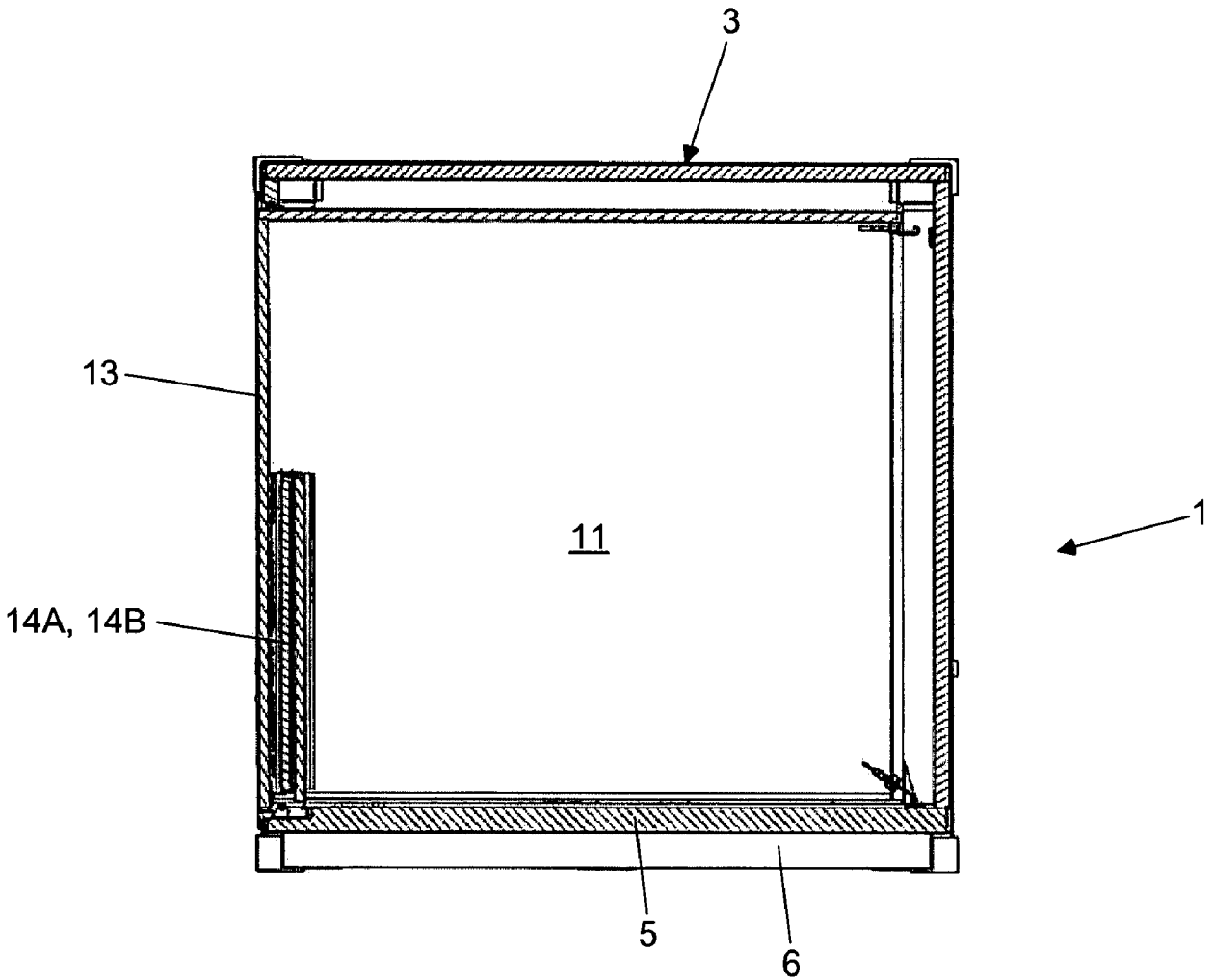
FIG. 6 is a sectional view of the single-side expandable shelter system of the present invention arranged in its transport configuration without interior equipment mounted therein, taken along line D-D of FIG. 4, showing the floor panels of the expandable section arranged in a folded configuration so as to take up minimal space within the interior of the shelter system.
Figure 7:
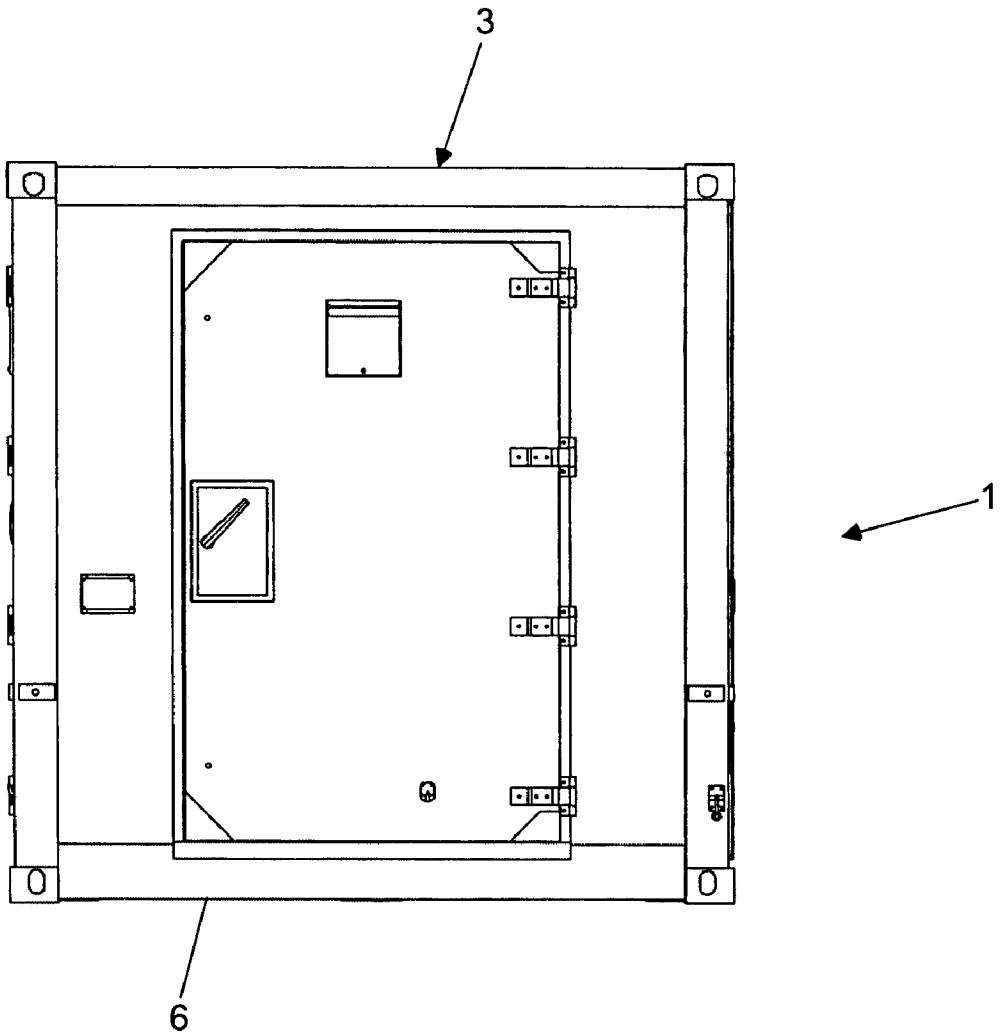
FIG. 7 is an end view of the exterior of the single-side expandable shelter system of the present invention arranged in its transport configuration without interior equipment mounted therein, and showing it side door closed.
Figure 8:
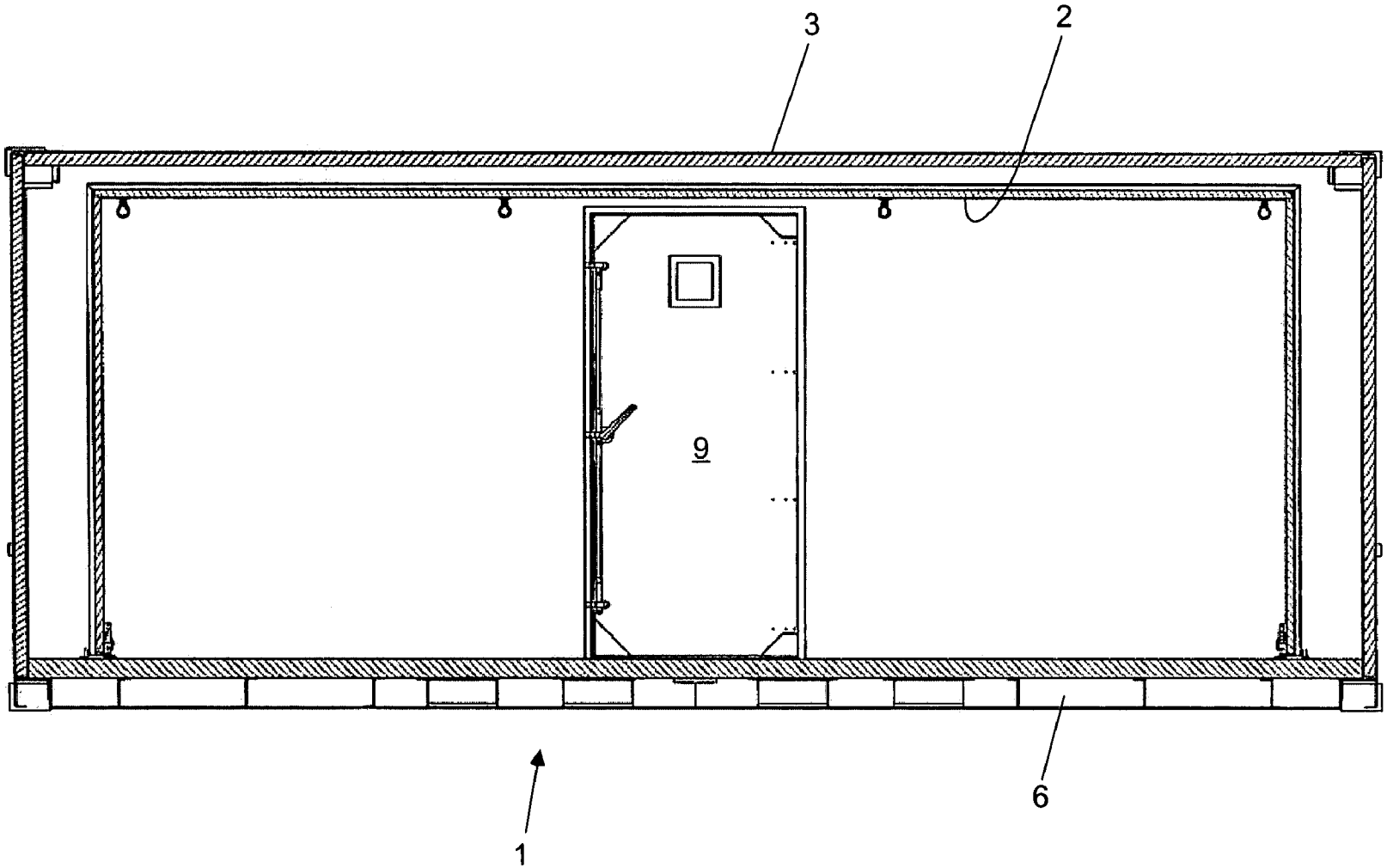
FIG. 8 is a sectional view of the single-side expandable shelter system of the present invention arranged in its transport configuration without interior equipment mounted therein, taken along line E-E of FIG. 7, and showing the interior of the front door of the shelter system.
Figure 9:
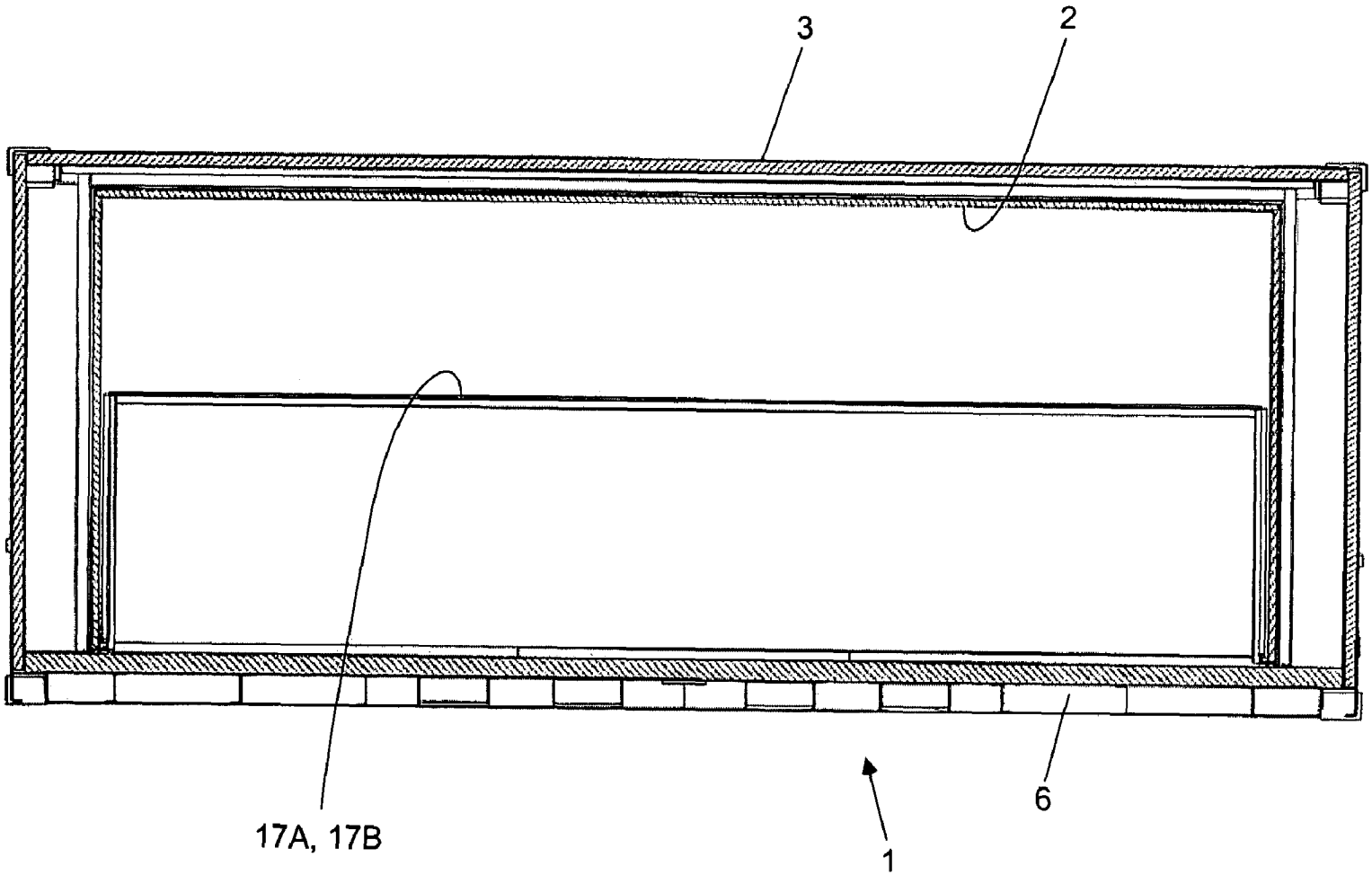
FIG. 9 is a sectional view of the single-side expandable shelter system of the present invention arranged in its transport configuration without interior equipment mounted therein, taken along line F-F of FIG. 7, and showing the interior of the shelter system along that view.

Referring to the figures in the accompanying Drawings, the various illustrative embodiments of the expandable shelter system of the present invention will be described in great detail, wherein like elements will be indicated using like reference numerals.

In FIGS. 1 through 25, a single-side expandable shelter system according to the principles of the present invention is shown in great detail. Also, in FIGS. 26 through 35, a double-side expandable shelter system of the present invention is illustrated in great detail. In general, the expandable shelter system of the present invention has two distinct modes of configuration, namely: a transport mode in which the side expandable section(s) are completely nested within an (ISO-style) main or central shelter section; and a deployment (i.e. operating) mode or configuration in which the side expandable section are completely protracted from the main section.

In each of these embodiments of the present invention, the flooring structure of the side expandable section(s) is realized as a hinged flooring panel assembly consisting of at least two floor panels hinged together so that they can be stacked compactly in a vertically elongated direction when the corresponding side expandable section is retracted within the main/central shelter section of the expandable shelter system, in a nested manner, as to be completed contained therewithin its transport mode/configuration.

Several important benefits follow from this particular technical feature of the present invention, namely: equipment can be now permanently mounted on the floor structure of the central/main section of the shelter system; each expanding section of the expandable shelter system can now have an interior volume that is substantially the same as the interior volume of the central shelter section, thereby maximizing the total utilizable volume of the expandable shelter system in its deployment mode; electronic equipment can be permanently mounted to the upper half of the three walls of each expandable side section thereby allowing for permanent interconnection of this equipment; and complex floor leveling subsystem are completely eliminated, thereby reducing cost, complexity and points of failure in the expandable shelter system design of the present invention. These and other benefits of the present invention will become apparent as the various illustrative embodiments are described in the greater detail below.

Figure 10:
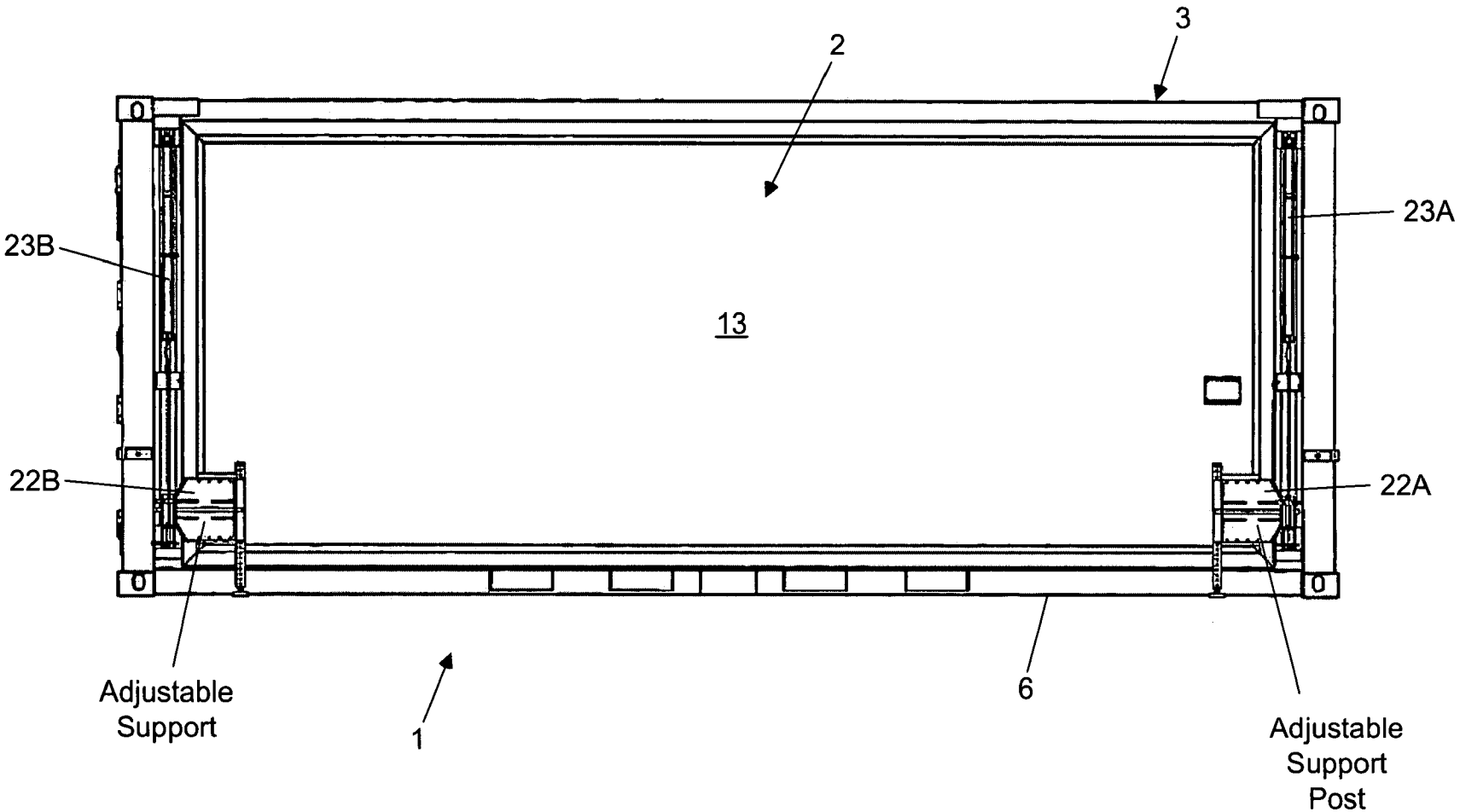
FIG. 10 is an elevated side view of the single-side expandable shelter system of the present invention arranged in its transport configuration without interior equipment mounted therein, showing the side wall panel of expandable section of the shelter system, while still nested within the main shelter section.
Figure 11A:
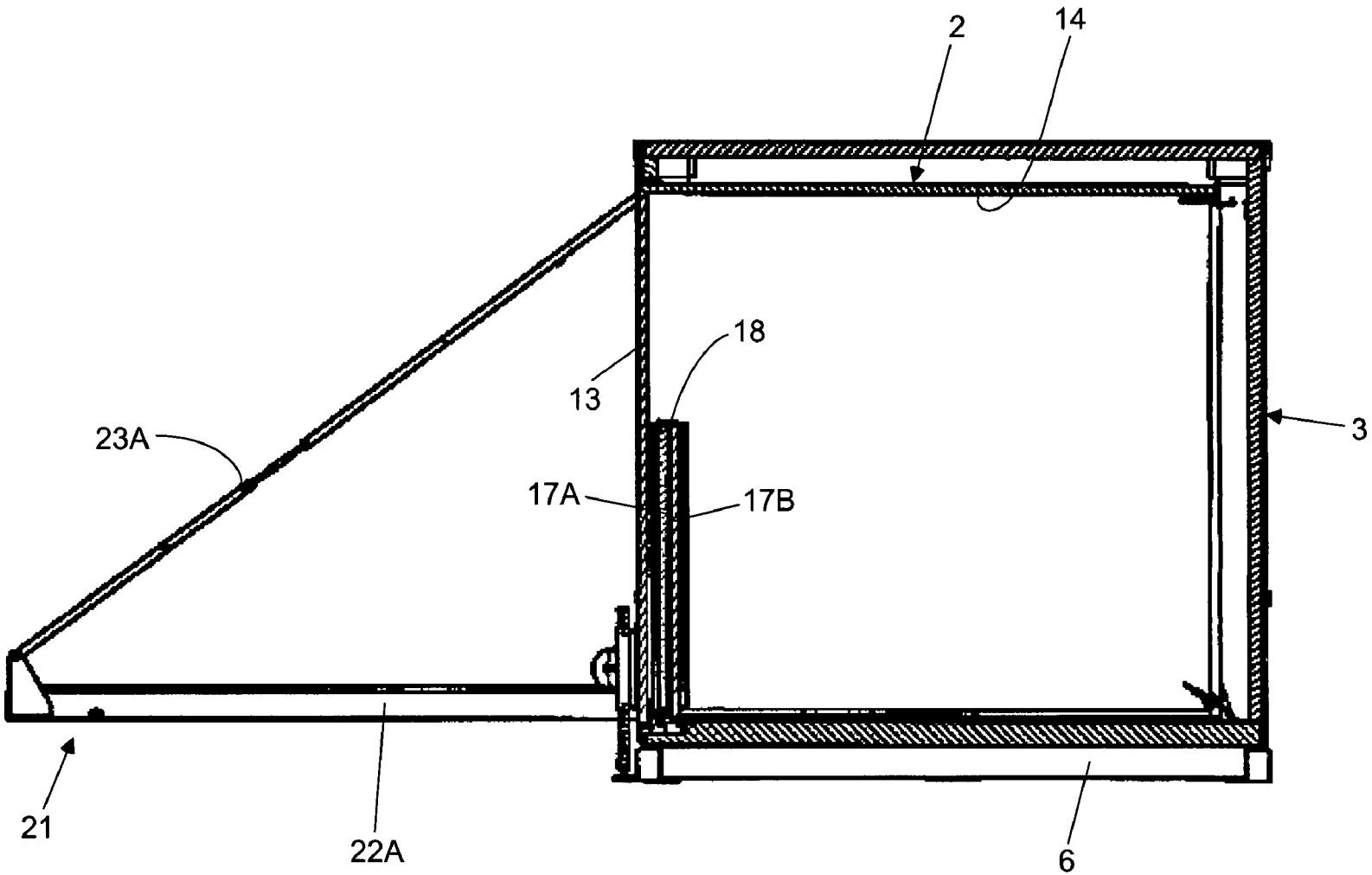
FIG. 11A is a first sectional view of the single-side expandable shelter system of the present invention arranged in the first phase of its deployment configuration without interior equipment mounted therein, taken along line D-D of FIG. 4, showing that side wall section has been lowered down in a horizontal orientation, but the floor panels of the expandable section still arranged in a folded configuration.
Figure 11B:
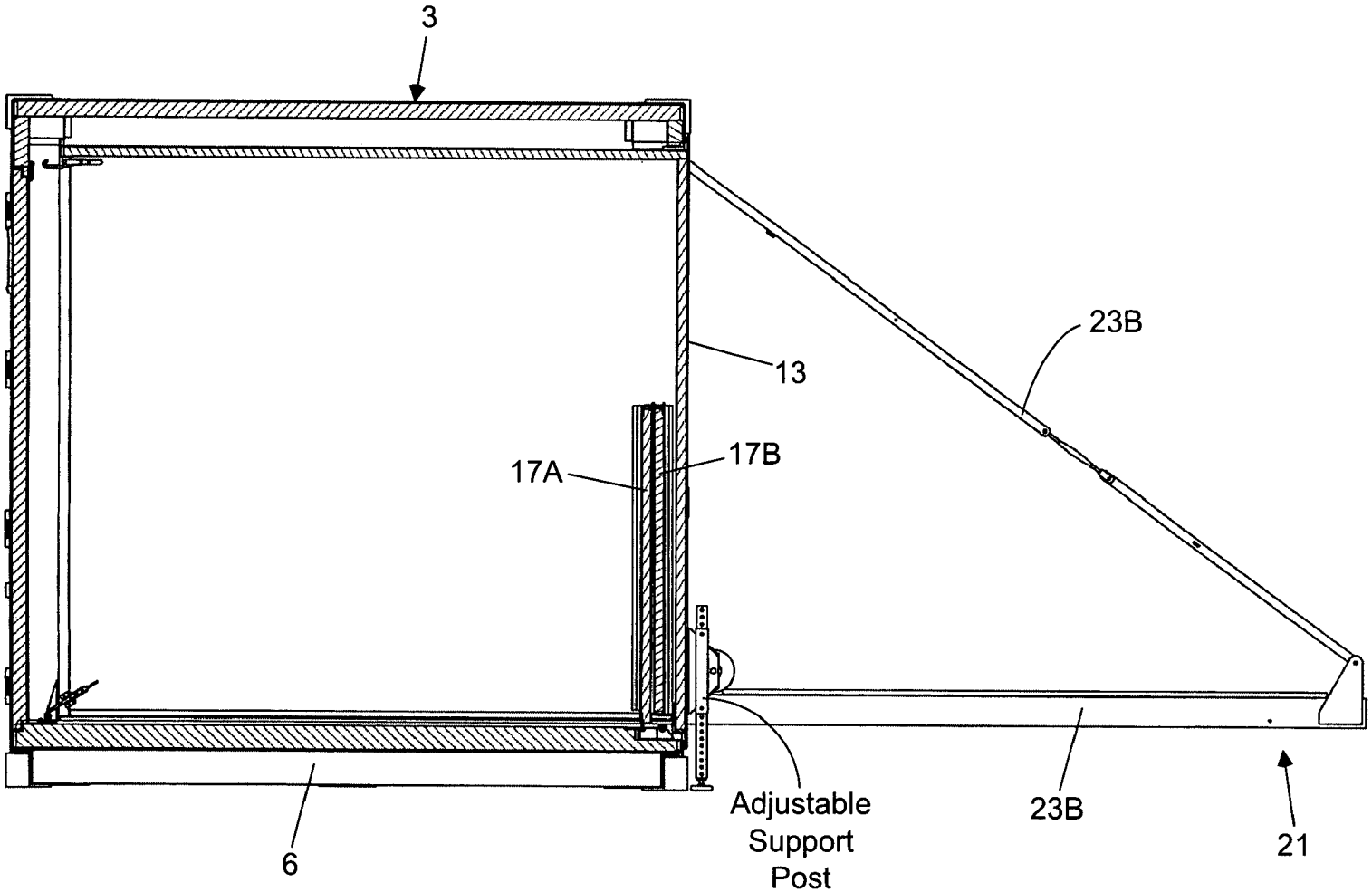
FIG. 11B is a second sectional view of the single-side expandable shelter system of the present invention arranged in a first phase of its deployment configuration without interior equipment mounted therein, taken along line D-D of FIG. 4, showing that side wall section has been lowered down in a horizontal orientation, but the floor panels of the expandable section still arranged in a folded configuration.
Figure 12:
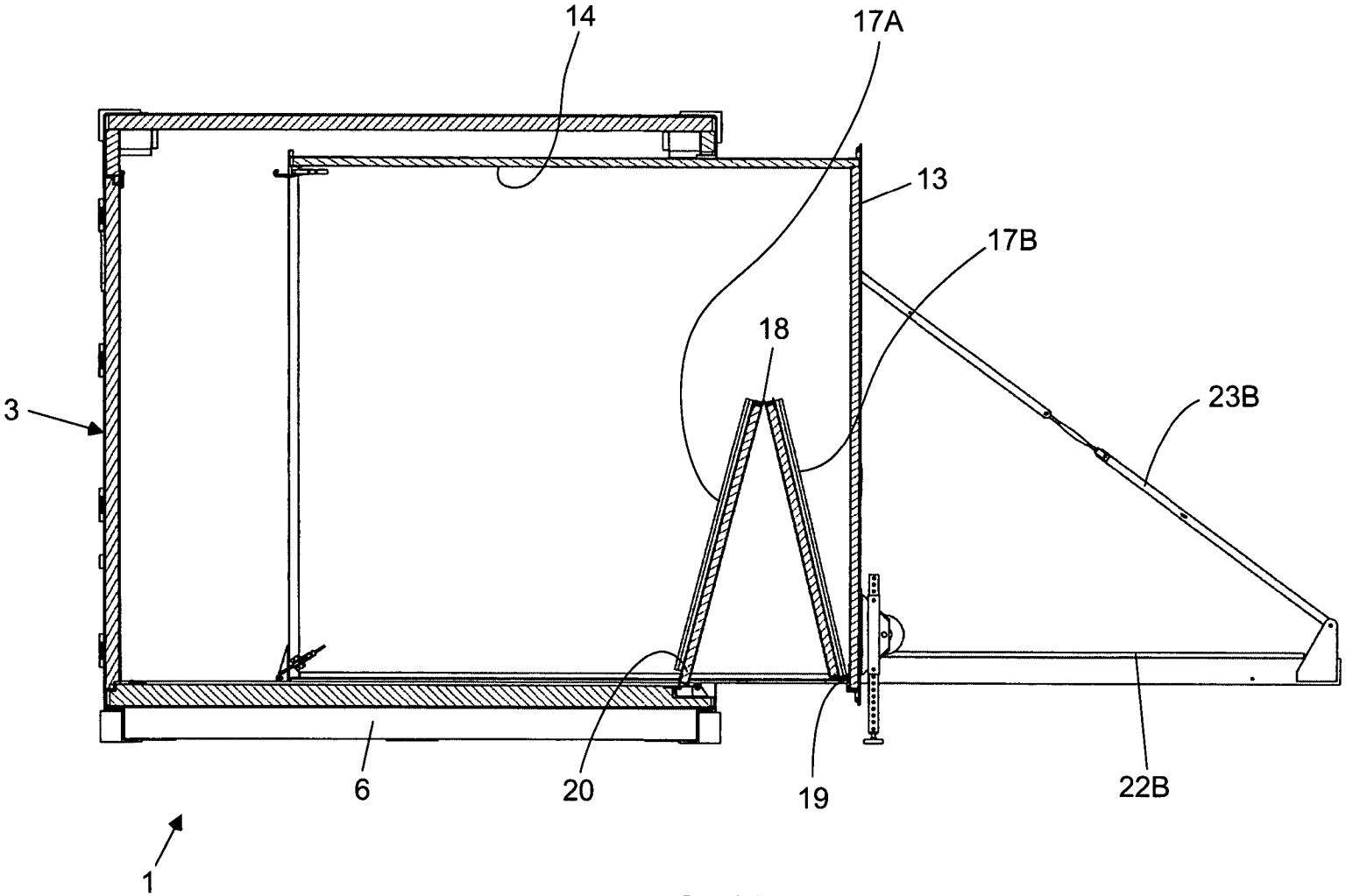
FIG. 12 is a first sectional view of the single-side expandable shelter system of the present invention arranged in a second phase of its deployment configuration without interior equipment mounted therein, taken along line D-D of FIG. 4, showing that side wall section has been lowered down in a horizontal orientation, and the floor panels of the expandable section being unfolded as the expandable shelter section is pulled out from the main shelter section of the shelter system.
Figure 13:
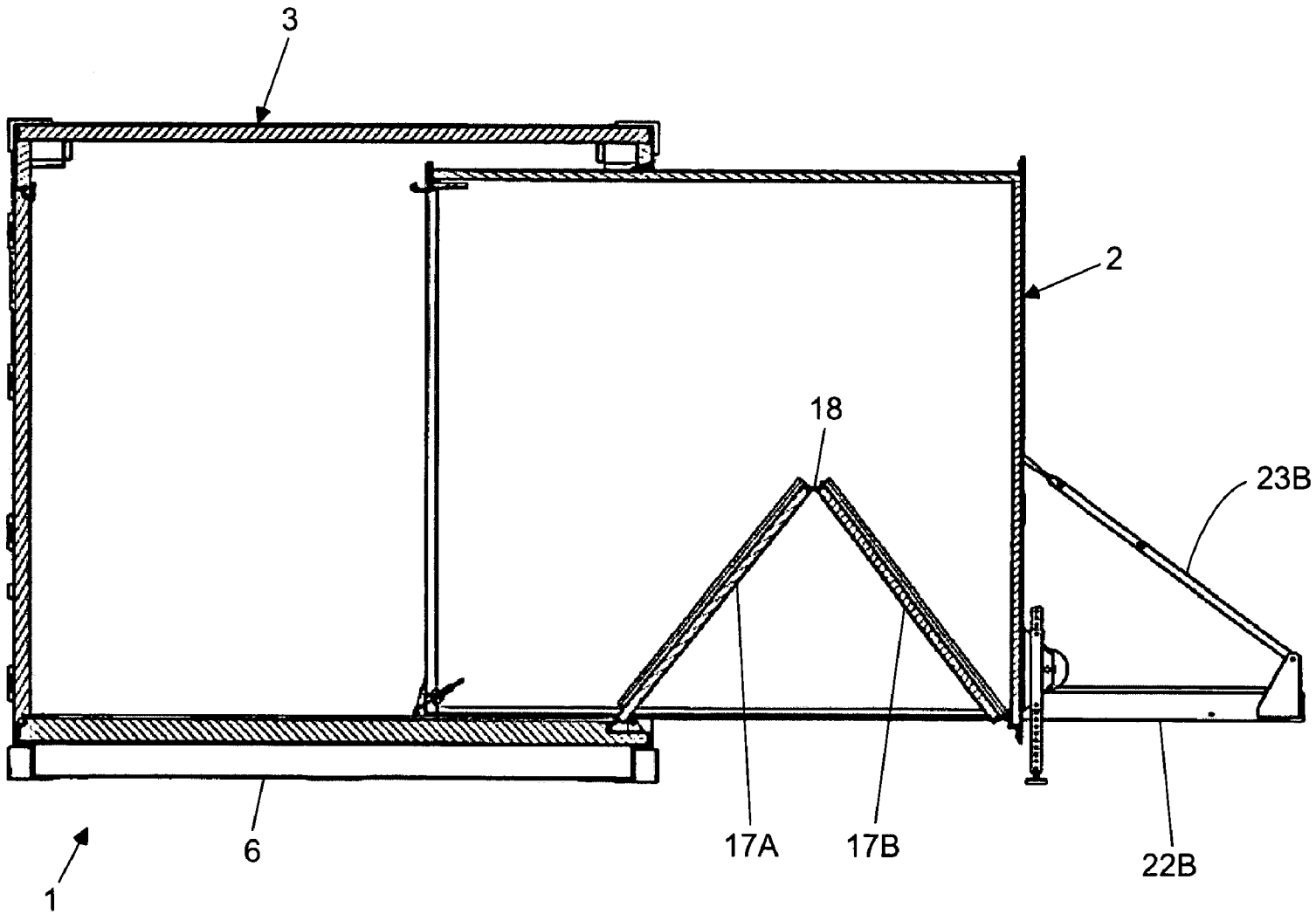
FIG. 13 is a first sectional view of the single-side expandable shelter system of the present invention arranged in a third phase of its deployment configuration without interior equipment mounted therein, taken along line D-D of FIG. 4, showing that side wall section has been lowered down in a horizontal orientation, and the floor panels of the expandable section being further unfolded as the expandable shelter section is pulled farther out from the main shelter section of shelter system.
Figure 14:
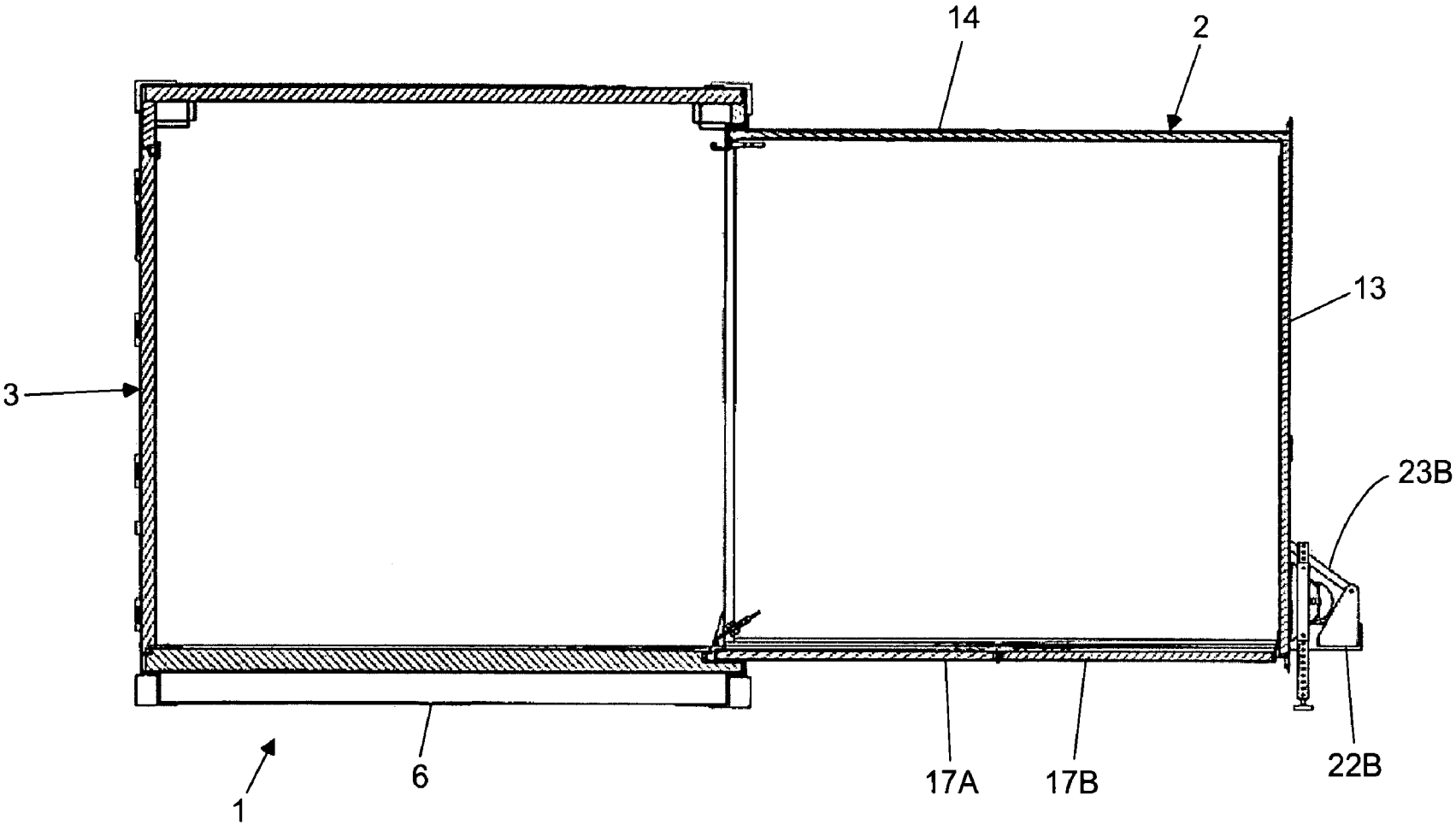
FIG. 14 is a first sectional view of the single-side expandable shelter system of the present invention arranged in a fourth and final phase of its deployment configuration (i.e. full deployment configuration) without interior equipment mounted therein, taken along line D-D of FIG. 4, showing that side wall section has been lowered down in a horizontal orientation, and the floor panels of the expandable section have been further completely unfolded upon the expandable shelter section being pulled maximally out from the main shelter section of shelter system.
Figure 15A:
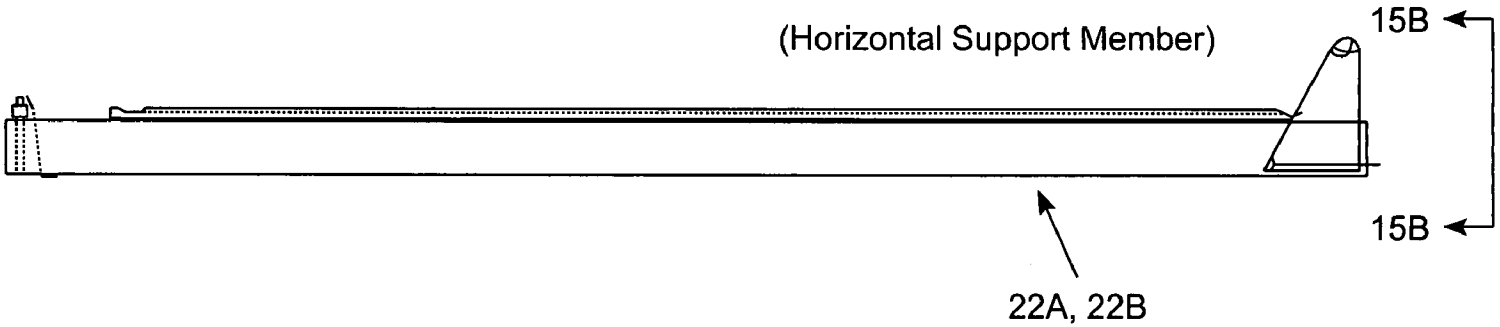
FIGS. 15A and 15B are elevated and end views of the horizontal support members used in the side expandable section translation mechanism used in the shelter system of the present invention.
Figure 15B:
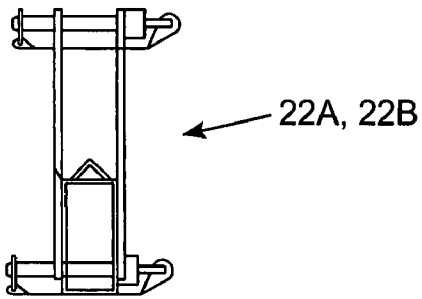
Figure 16:
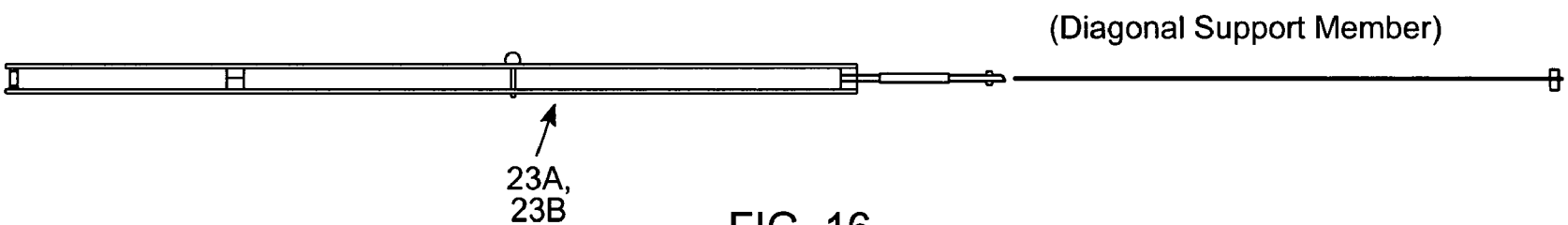
FIG. 16 is an elevated view of the diagonal support members used in the side expandable section support mechanisms.
Figure 17A:
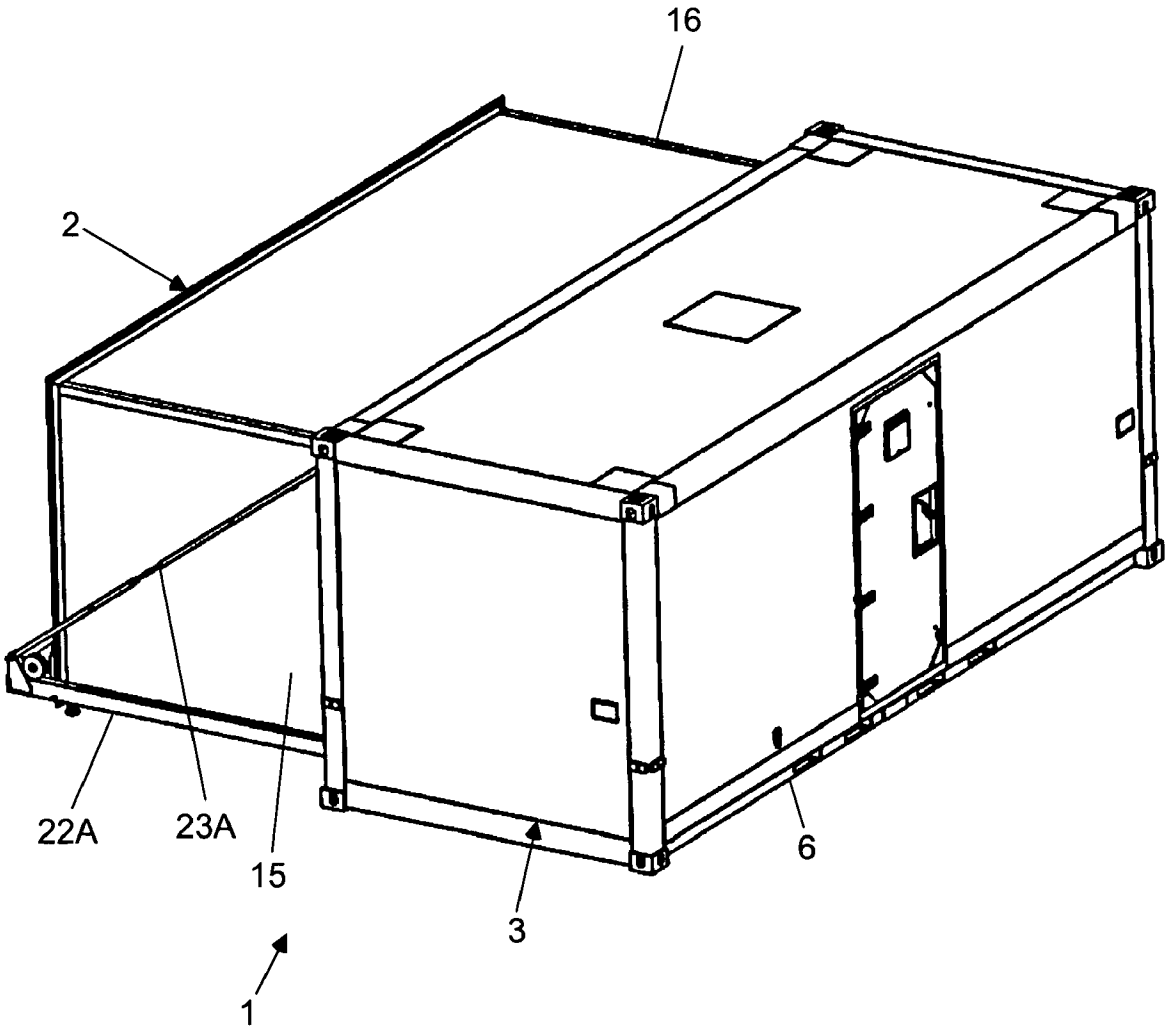
FIG. 17A is a first perspective view of the single-side expandable shelter system of the present invention arranged in its full deployment configuration without any interior equipment mounted therein, showing its front door arranged in a closed configuration.
Figure 17B:
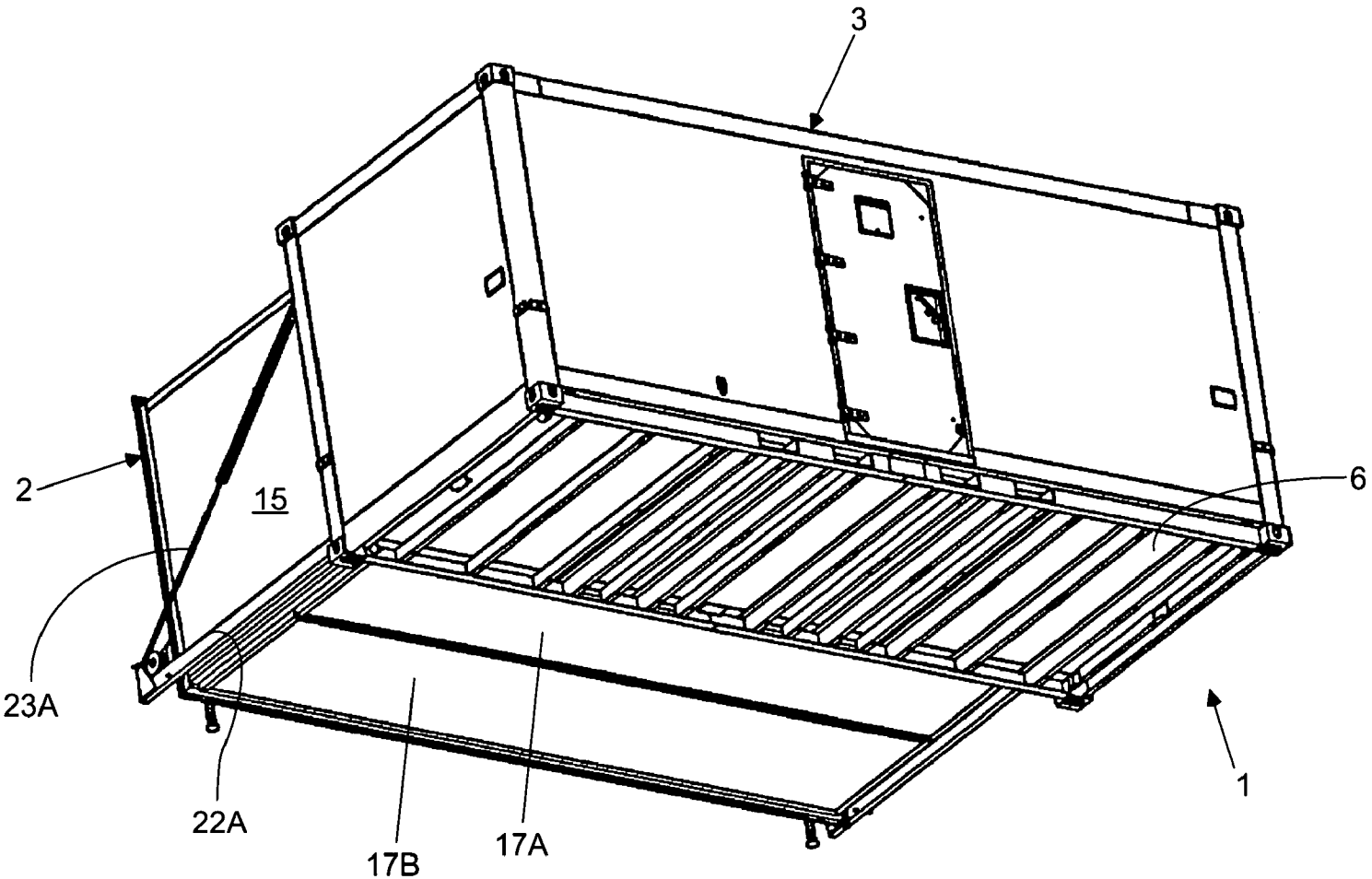
FIG. 17B is a second perspective view of the single-side expandable shelter system of the present invention arranged in its full deployment configuration without any interior equipment mounted therein, showing the full-length replaceable skid structure affixed to the bottom of the main shelter section and bottom of the expandable side section lying substantially within the same plane as the bottom floor of the main shelter section.
Figure 17C:
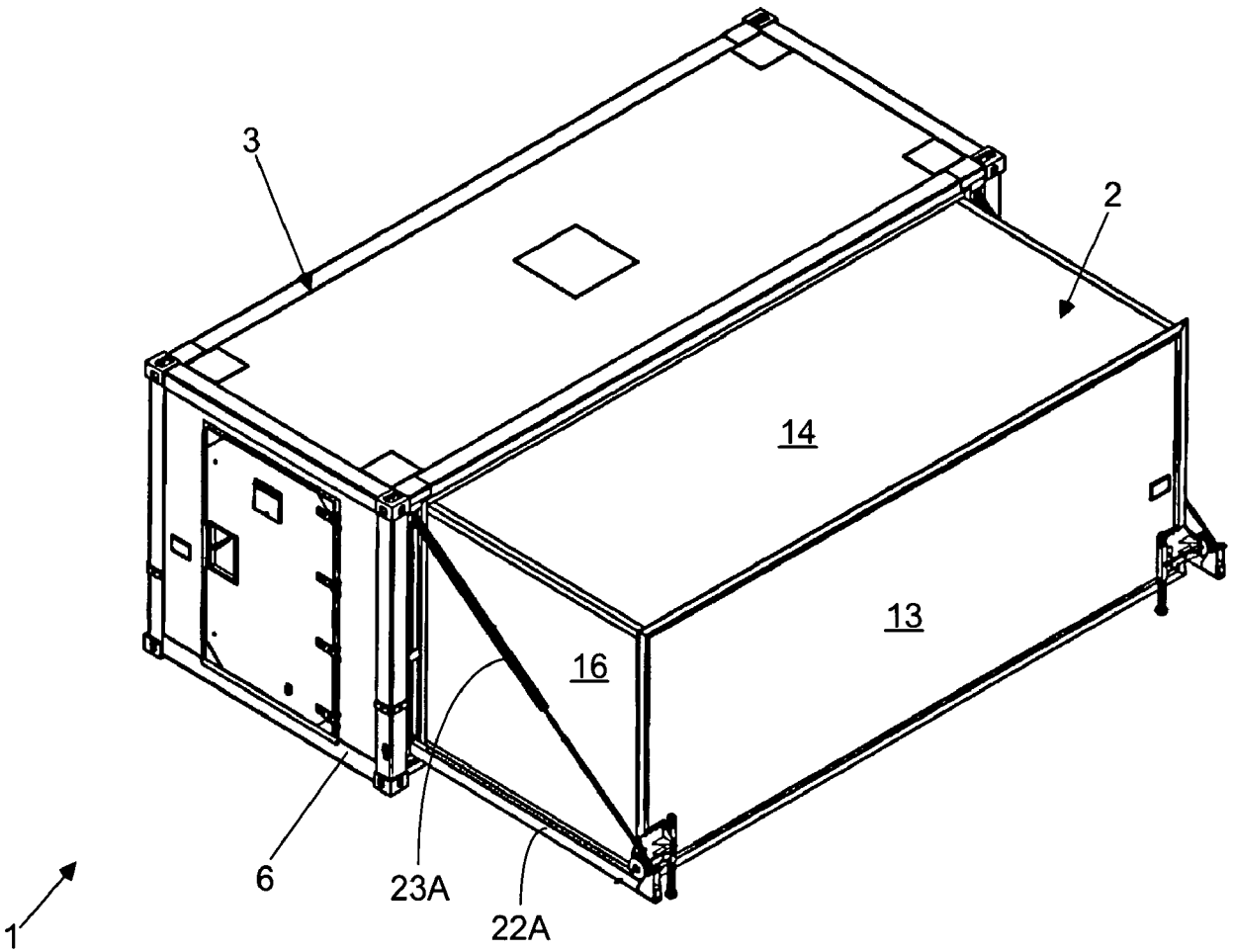
FIG. 17C is a third perspective view of the single-side expandable shelter system of the present invention arranged in its full deployment configuration without any interior equipment mounted therein, showing that the expanded side section has substantially the same volumetric dimensions as the main shelter section of the shelter system.
Figure 18:
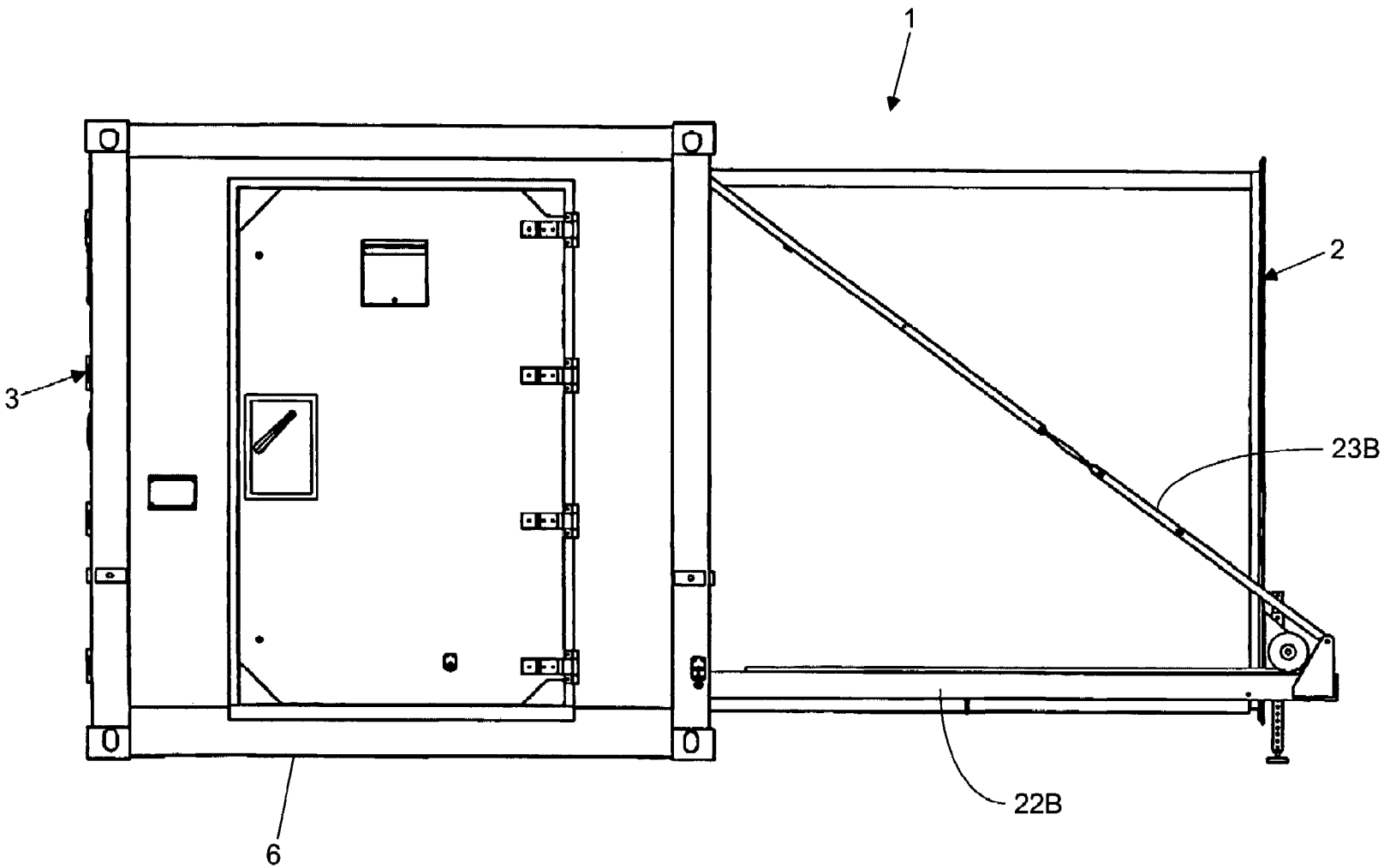
FIG. 18 is an elevated side view of the single-side expandable shelter system of the present invention arranged in its full deployment configuration without any interior equipment mounted therein, showing that the expanded side section has substantially the same (i.e. side dimensions as the main shelter section of the shelter system.
Figure 19:
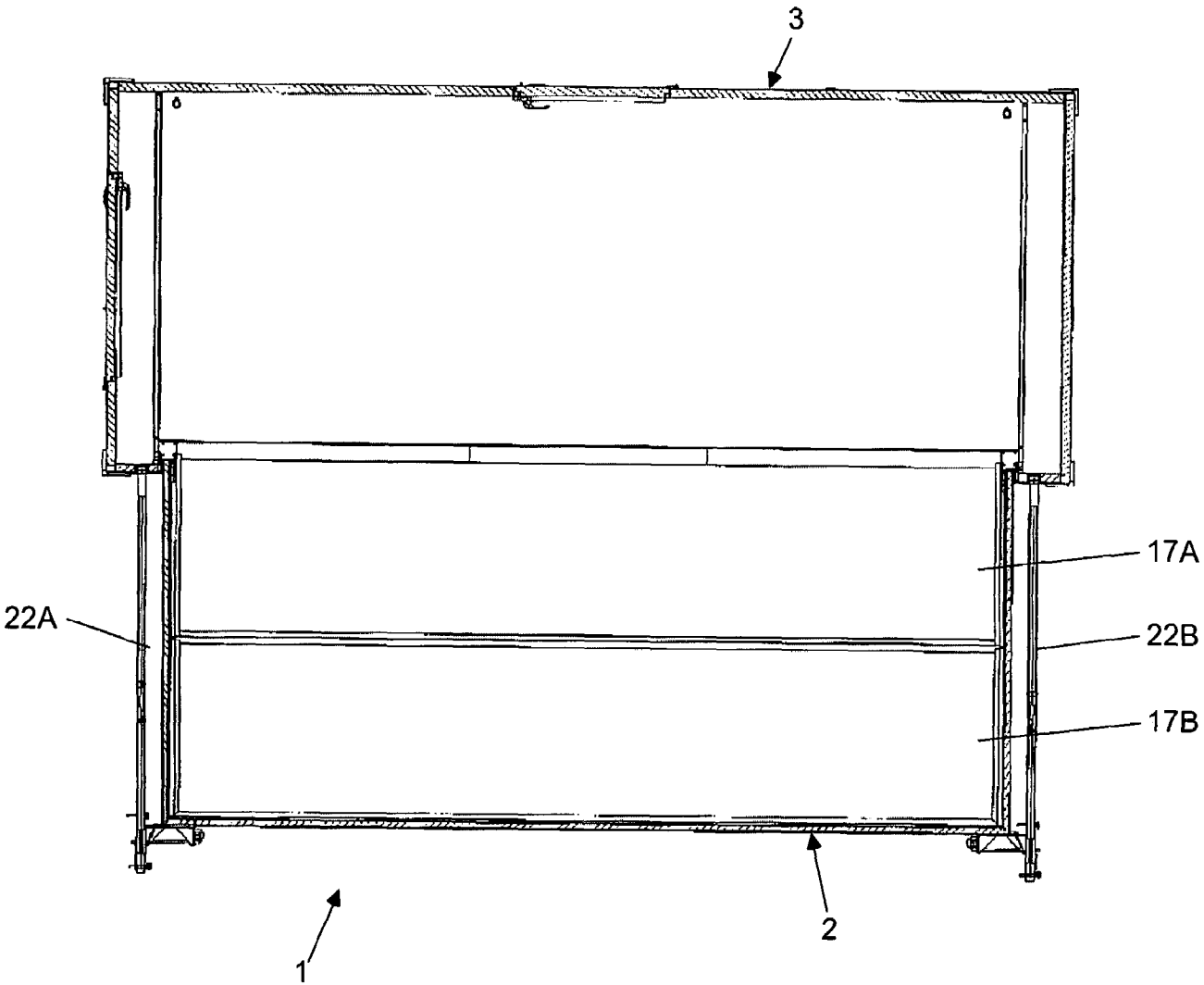
FIG. 19 is a bottom plan side view of the single-side expandable shelter system of the present invention arranged in its full deployment configuration without any interior equipment mounted therein, showing that the expanded side section has substantially the same floor dimensions as the main shelter section of the shelter system.

In FIGS. 1 and 10, the single-side expandable shelter system of the present invention, constructed in accordance with ISO standards, 1 is shown arranged in its transport mode/configuration from different views, with its expandable section 2 nested inside the main shelter section 3 and its side door 4 arranged in its closed configuration during transport. As shown, the single side expandable shelter system 1 comprises: main shelter section 3 having (i) a floor structure 5, beneath which a replaceable full-length skid structure 6 is affixed thereto, (ii) a top panel 7, a front panel 8 with a front door having open and closed configurations, and (iii) first and second side panels 10 and 11, interconnected within a framework constructed from frame members 12A through 12H, in a conventional manner in accordance with ISO standards, to form a five-sided box-line container with an open side along its length dimension; (2) a single five sided expandable section 2 having a front wall panel 13, a top panel 14, and first and second side panels 15 and 16, and a foldable flooring assembly including first and second flooring sections 17A and 17B that hinged together at point 18 and with the bottom of the front wall panel 19 and the edge of the floor structure 20 of the main shelter section; and (3) a side expandable section support mechanism 21 including, in the illustrative embodiment, (a) a pair of hinged horizontally-extending expansion section support 22A and 22B which (i) are hingedly connected at one end to the bottom exterior of the main shelter section as shown, and their other ends by a pair of diagonally-extending cables 23A and 23B connected to the top portion of the main shelter section as shown.

During deployment, the horizontal side section support members 22A and 22B, and diagonal support members 23A and 23B, support the side expandable section when it is being projected out from within the interior volume of the main shelter section.

Optionally, a motor can be fixedly mounted to the bottom of the front side panel 13 of the side expansion section 2, and provided with gears that ride along guide tracks formed in support member 22A or 22B, and (i) pull the side expandable section out from the interior volume of the main section when the shelter system is being configured into its deployment mode, and (ii) push the side expandable section into from the interior volume of the main section, during the transport mode, as shown in FIGS. 11A through 14. The motor can be realized as a hand-operated winch device operated by manually turning a crank mechanism, or by a electric motor. In either case, the side expandable section support mechanism 21 can be modified as such to provide such automated or semi-automated transport of the side section into and out of the main shelter section during transitions between transport and deployment modes of operation.

In FIGS. 11 through 14, the shelter system is shown being reconfigured from its transport mode into its deployment/operating mode. During this configuration process, the side expandable section support mechanism 21 is pulled down into its operating configuration with horizontal support members 22A, 22B resting slightly above the ground surface. During this process, the foldable flooring assembly 14A, 14B unfolds and assumes its horizontal position, while being supported along its outer edges by support flanges provided along the perimeter of side wall panels 15 and 16 and front wall panel 13 of the side section 2 during the final phase of the deployment mode of configuration. After the side section 2 is slid out from the main shelter section 3, the horizontal and diagonal support members support the side section 2 during deployment.

In FIGS. 15 through 19, the expandable shelter system is shown from various views while its configured in its deployment mode. For purposes of illustration, all figure drawings sets forth in FIGS. 1 through 19 are shown without any interior equipment mounted within the expandable shelter system in order to help illustrate the construction of the system, and illustrate the simplicity and elegance of this inventive design.

Figure 20A:
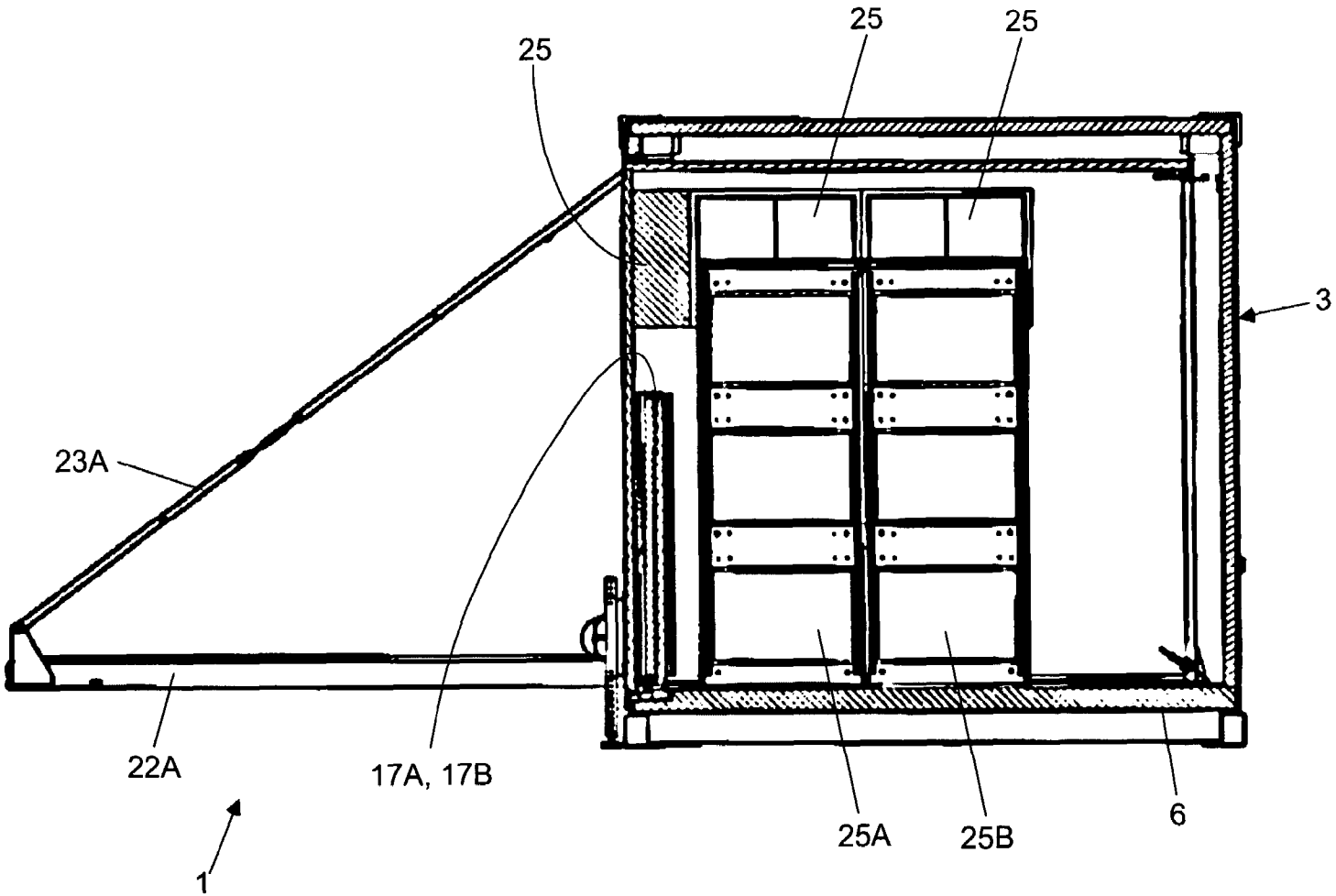
FIG. 20A is first sectional view of the single-side expandable shelter system of the present invention arranged in its transport configuration loaded with a full set of interior equipment and cabinet structures mounted therein, taken along line C-C of FIG. 4, showing that the expanded side section supports multiple cabinet structures on the upper wall surfaces, below the vertical height of the folded flooring sections, compactly stored away, while the floor structure of the main shelter section supports multiple cabinet structures, in accordance with a predetermined configuration of equipment and cabinet structures within the shelter system.
Figure 20B:
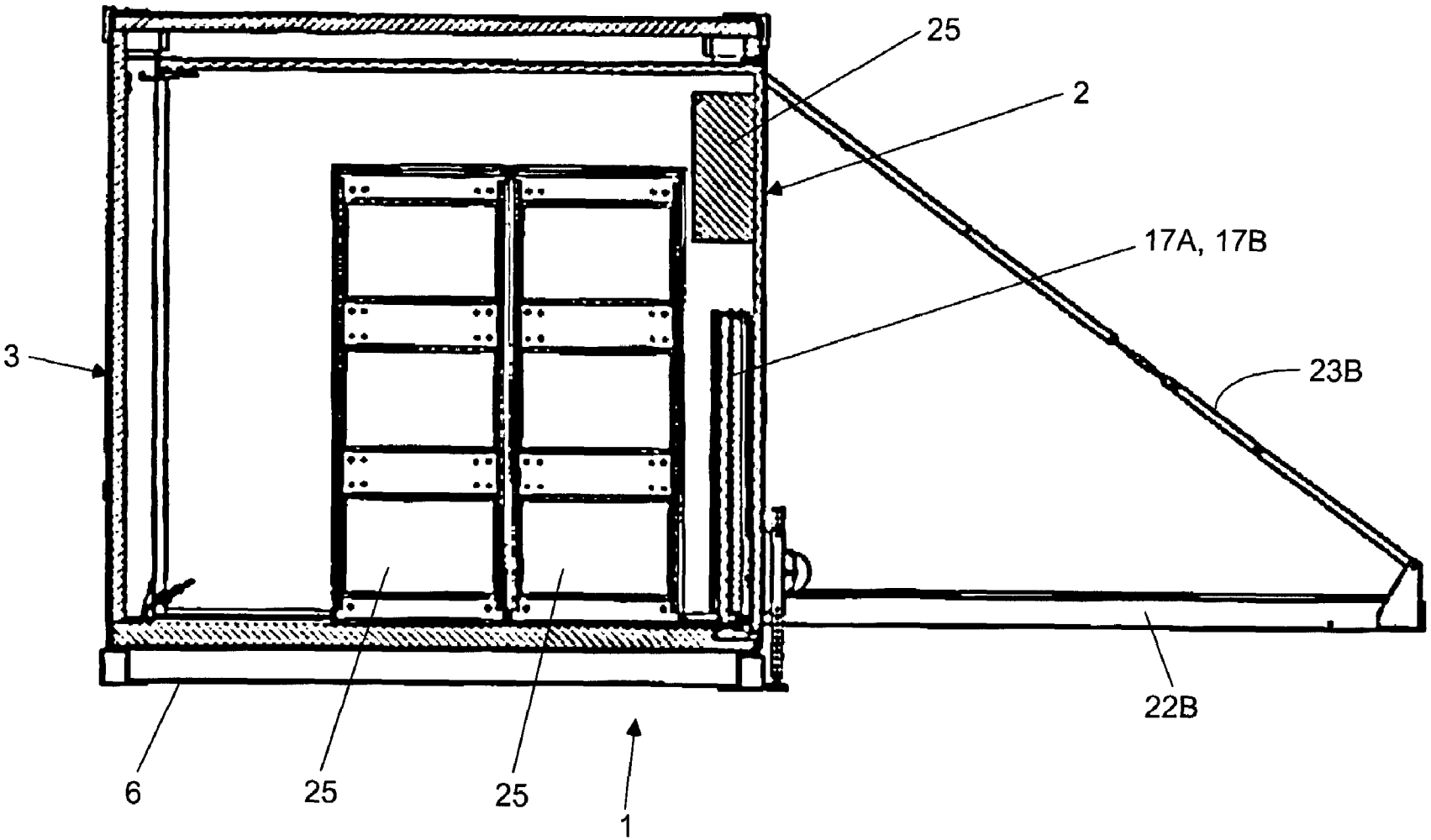
FIG. 20B is second sectional view of the single-side expandable shelter system of the present invention arranged in its transport configuration loaded with a full set of interior equipment and cabinet structures mounted therein, taken along line D-D of FIG. 4, showing that the expanded side section supports multiple cabinet structures on the upper wall surfaces, below the vertical height of the folded flooring sections, compactly stored away, while the floor structure of the main shelter section supports multiple cabinet structures, in accordance with a predetermined configuration of equipment and cabinet structures within the shelter system.
Figure 21:
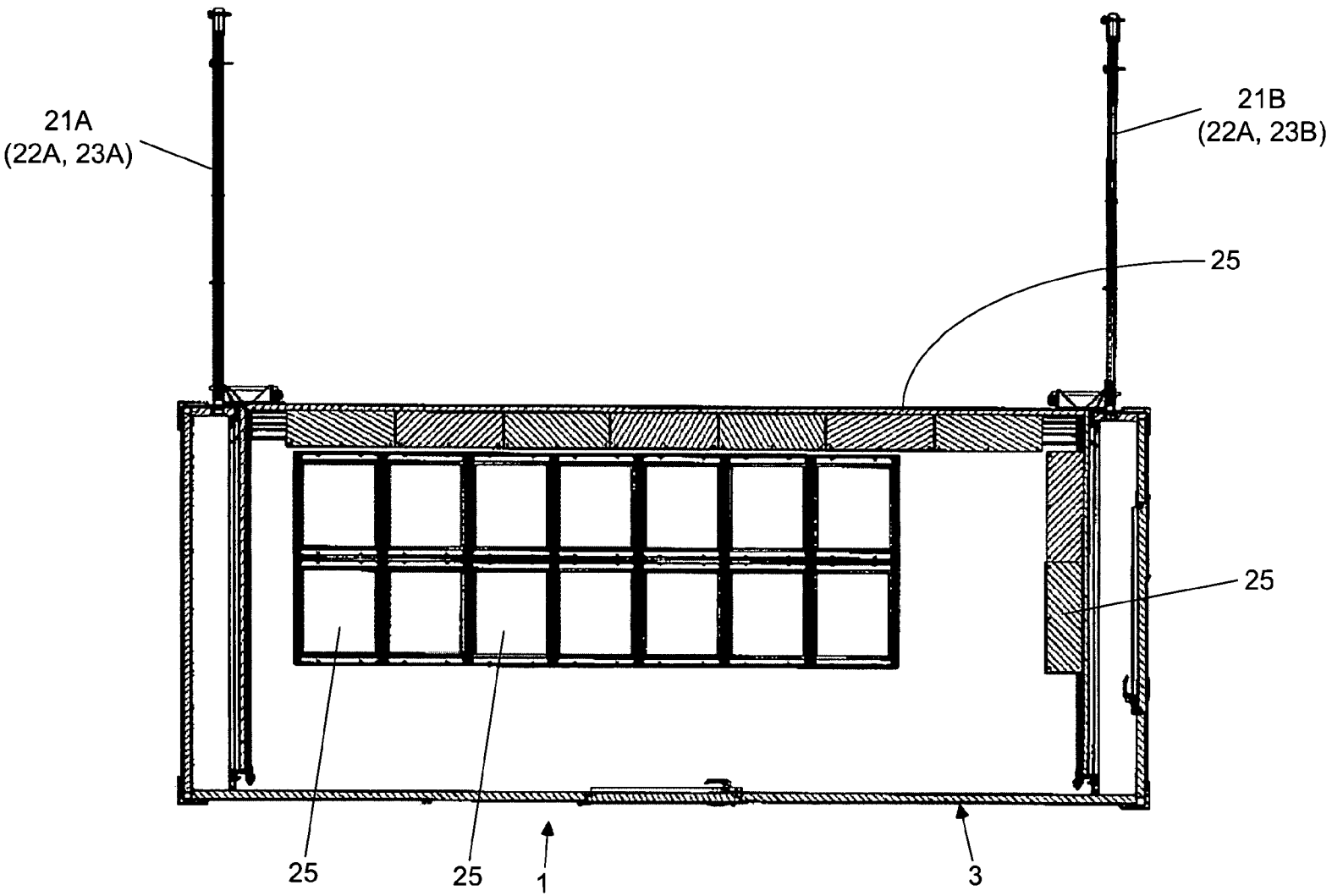
FIG. 21 is a sectional plan view of the single-side expandable shelter system of the present invention arranged in its transport configuration loaded with a full set of interior equipment and cabinet structures mounted therein, showing the location of multiple cabinet structures mounted on the upper wall surfaces of the expandable side section, and the multiple cabinet structures supported on the floor surface of the main shelter section of the shelter system.
Figure 22:
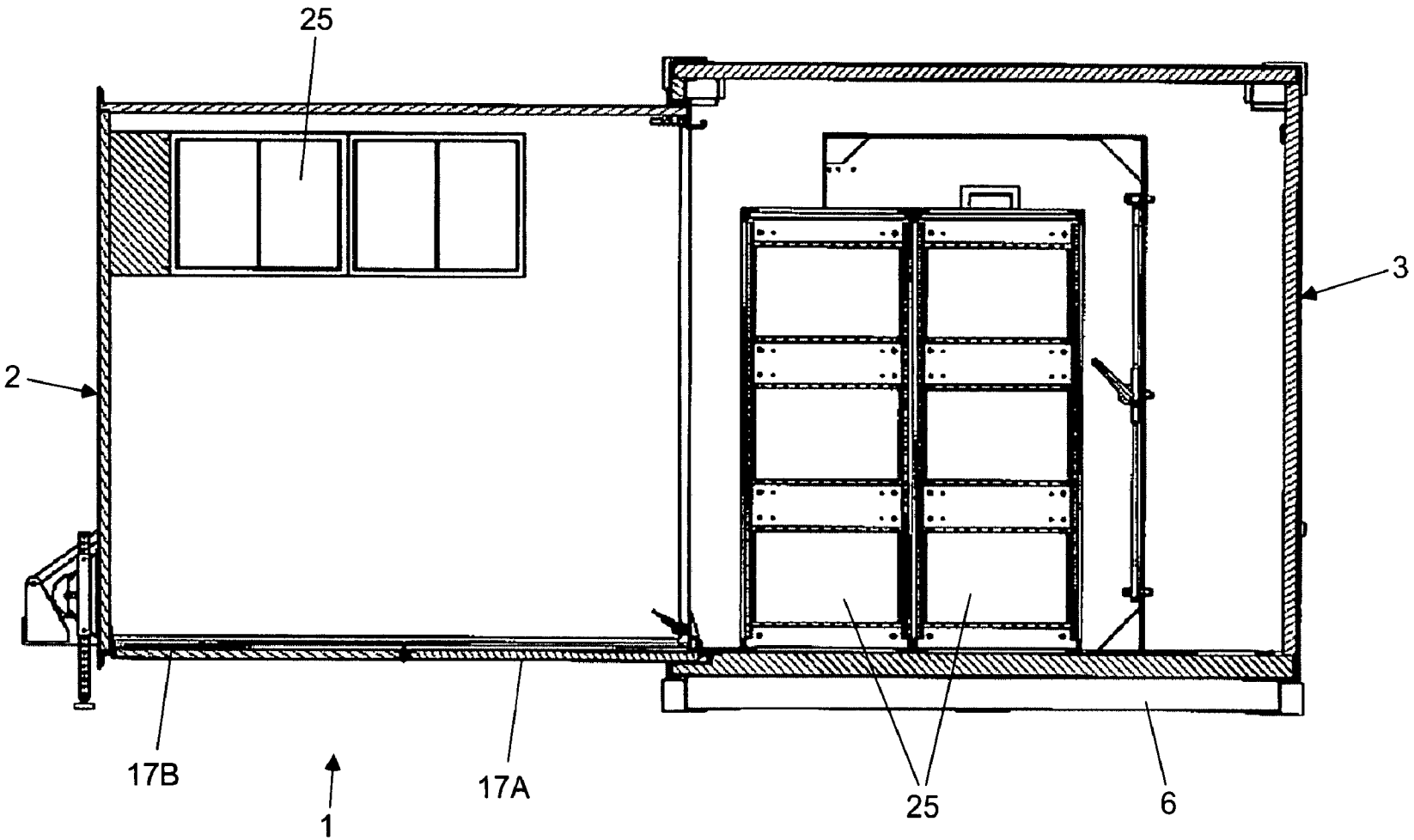
FIG. 22 is sectional view of the single-side expandable shelter system of the present invention arranged in its full deployment configuration loaded with a full set of interior equipment and cabinet structures mounted therein, showing that the expanded side section supports multiple cabinet structures on the upper wall surfaces, while the floor structure of the main shelter section supports multiple cabinet structures.
Figure 23:
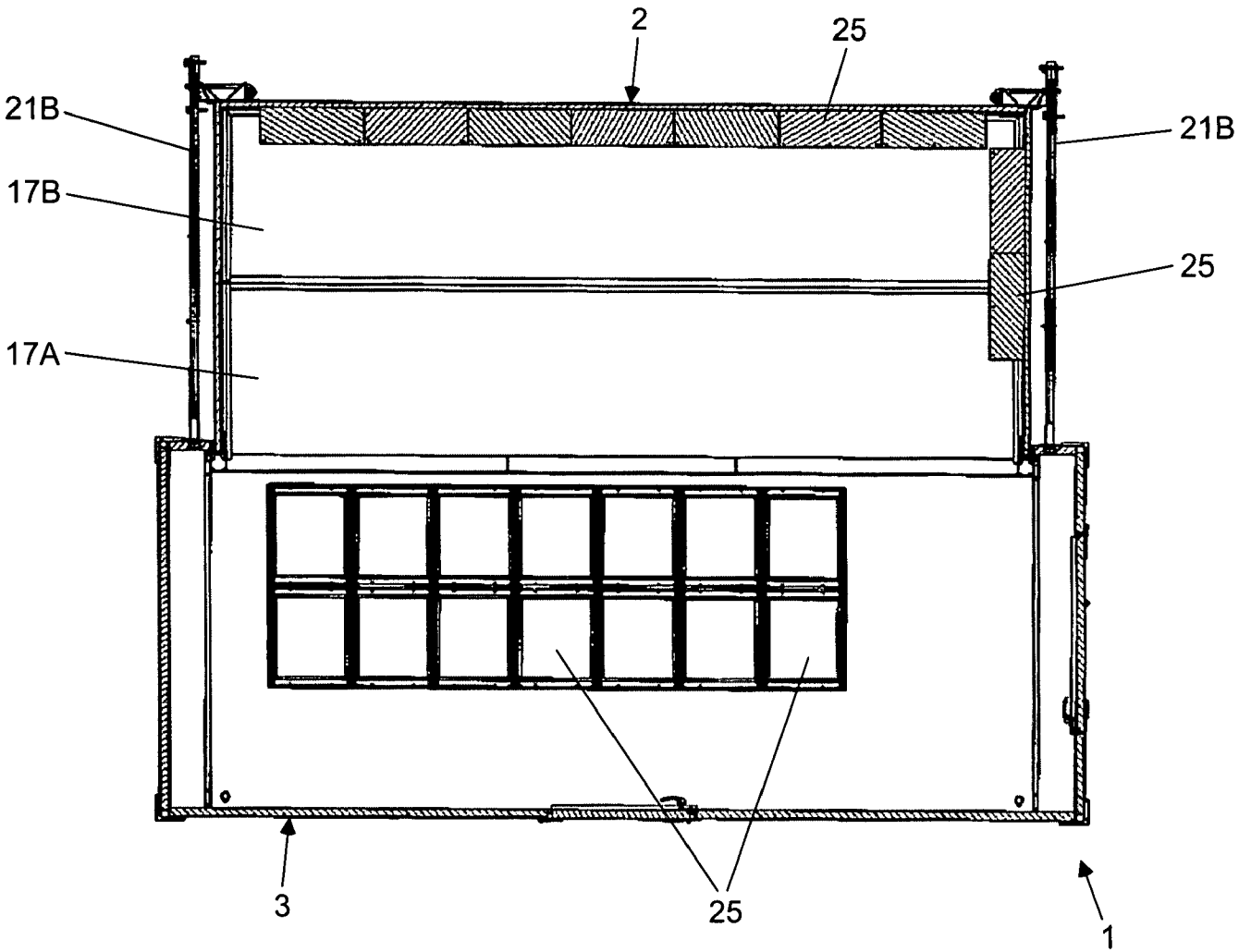
FIG. 23 is a sectional plan view of the single-side expandable shelter system of the present invention arranged in its full deployment configuration loaded with a full set of interior equipment and cabinet structures mounted therein, showing the location of multiple cabinet structures mounted on the upper wall surfaces of the expandable side section, and the multiple cabinet structures supported on the floor surface of the main shelter section of the shelter system.
Figure 24:
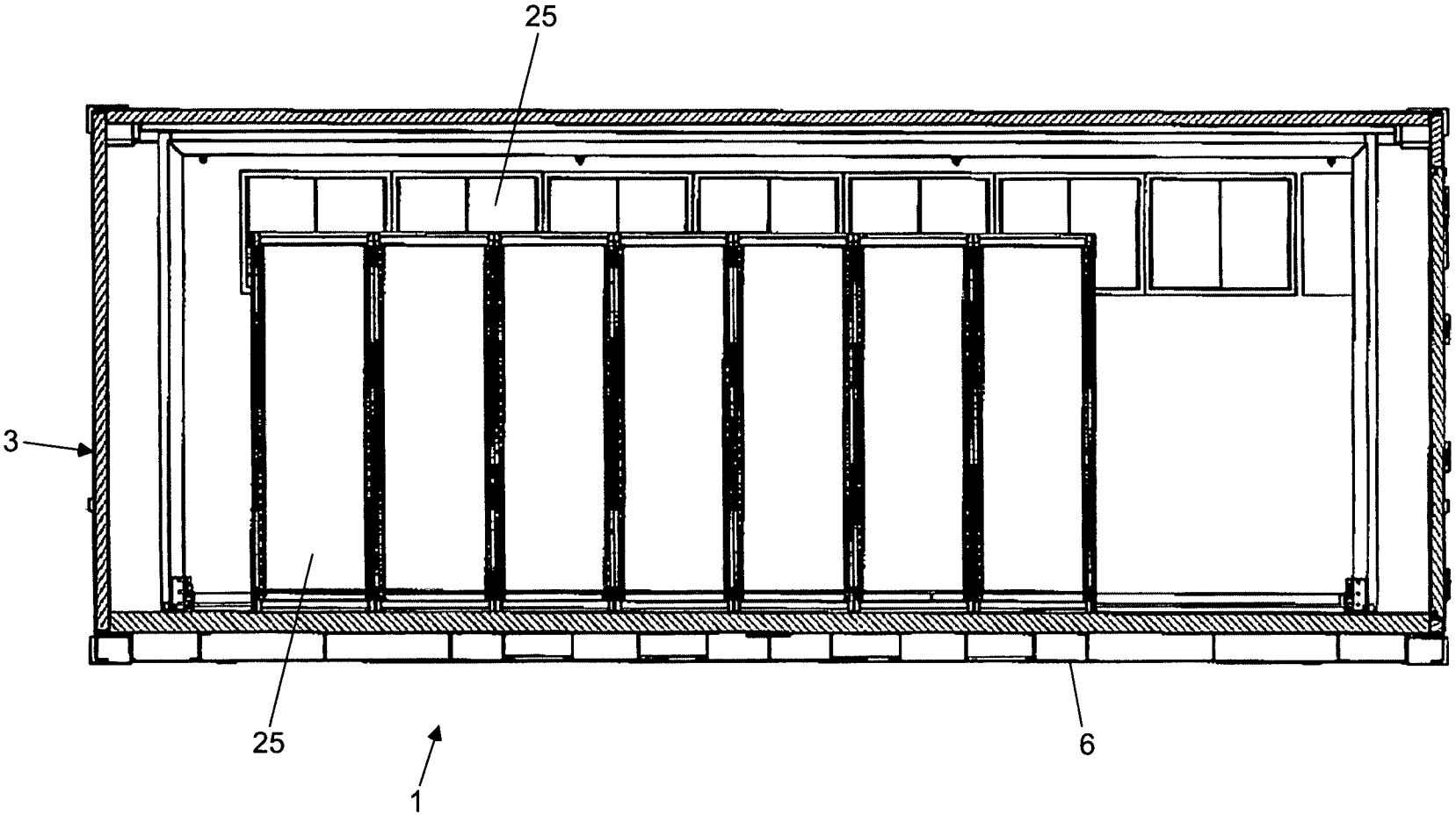
FIG. 24 is a sectional view of the single-side expandable shelter system of the present invention arranged in its transport configuration loaded with a full set of interior equipment and cabinet structures mounted therein, taken along line F-F of FIG. 7, showing the location of multiple cabinet structures mounted on the upper wall surfaces of the expandable side section, and behind the multiple cabinet structures supported on the floor surface of the main shelter section of the shelter system.
Figure 25:
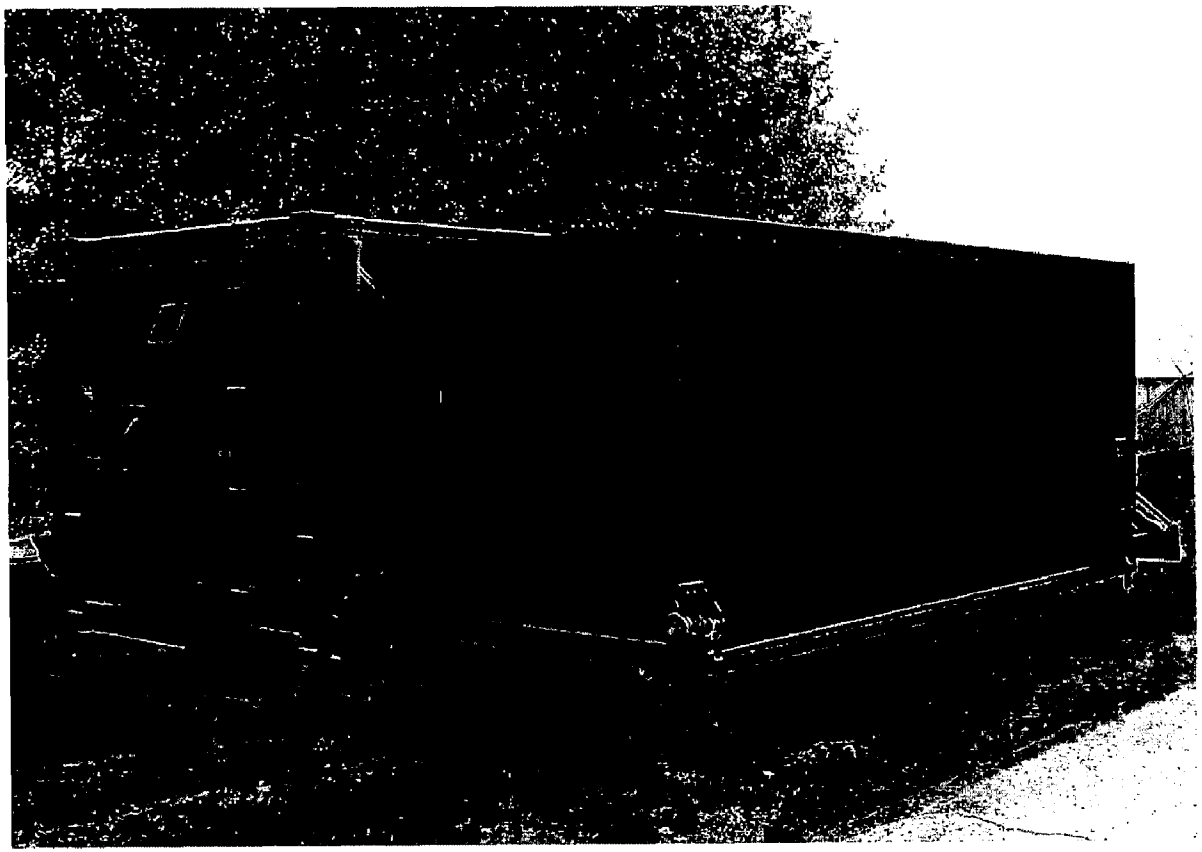
FIG. 25 is a perspective view of the single-side expandable shelter system of the present invention arranged in its transport configuration loaded with a full set of interior equipment and cabinet structures mounted therein.

In FIGS. 20A through 24, equipment of various kind (e.g. electronic equipment and rack and cabinet structures) 25 is shown mounted on both the interior wall surfaces and on the flooring structures within the expandable shelter system design to demonstrate the benefits that follow from the present invention. As shown in FIG. 20A, the expanded side section supports multiple cabinet structures 25 on the upper wall surfaces, below the vertical height of the folded flooring sections, while they are compactly stored away during the transport mode. Also, the floor structure of the main shelter section supports multiple cabinet structures, in accordance with a predetermined configuration of equipment and cabinet structures within the shelter system.

Referring now to FIGS. 26 through 35, the double-side expandable shelter system of the illustrative embodiment will be described in great detail in both its transport and deployment modes of configuration.

Figure 26:
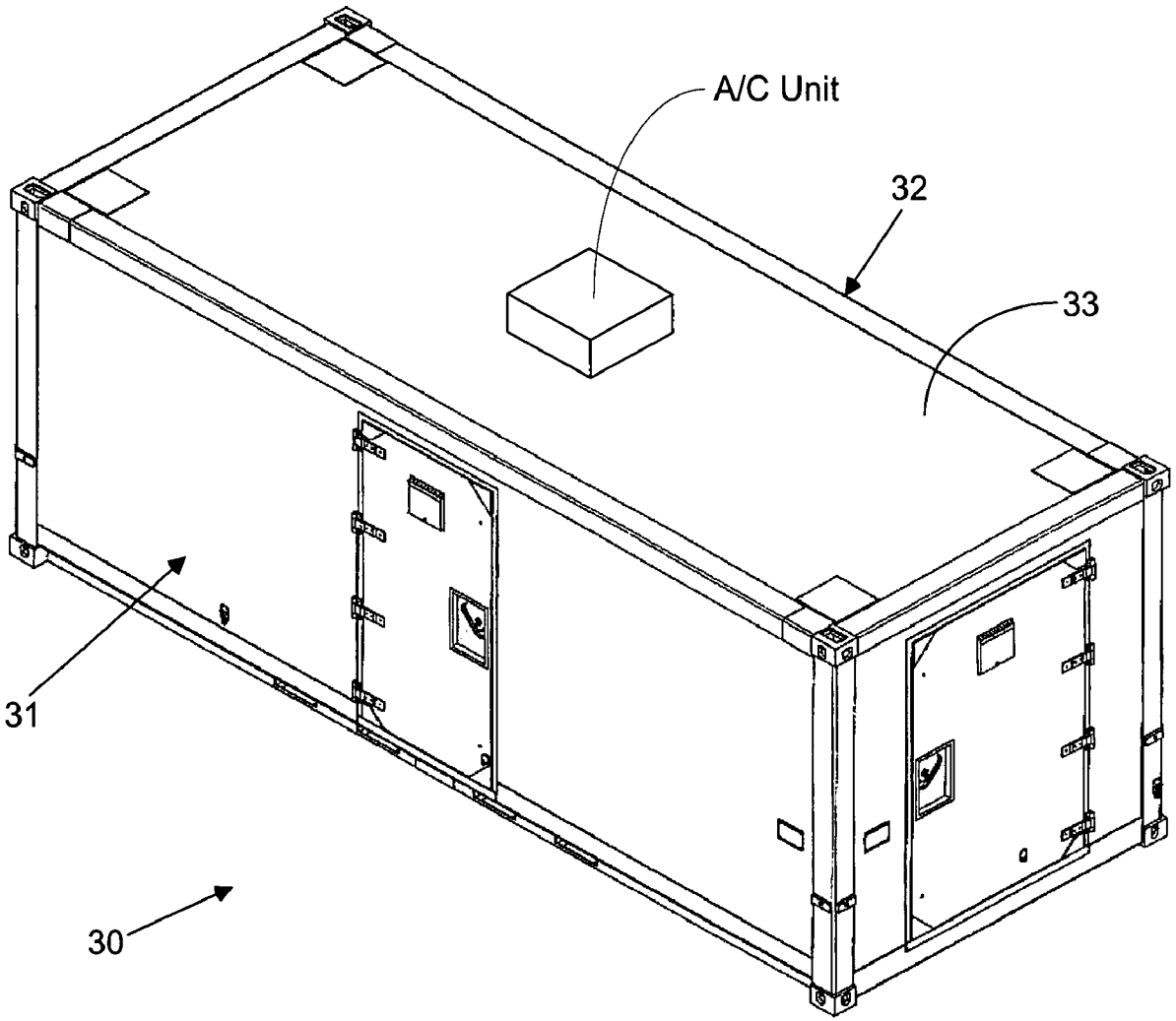
FIG. 26 is a perspective view of the double-side expandable shelter system of the present invention arranged in its transport configuration/mode, without interior equipment mounted therein, and showing both of its double expandable sections nested inside the main shelter section.
Figure 27:
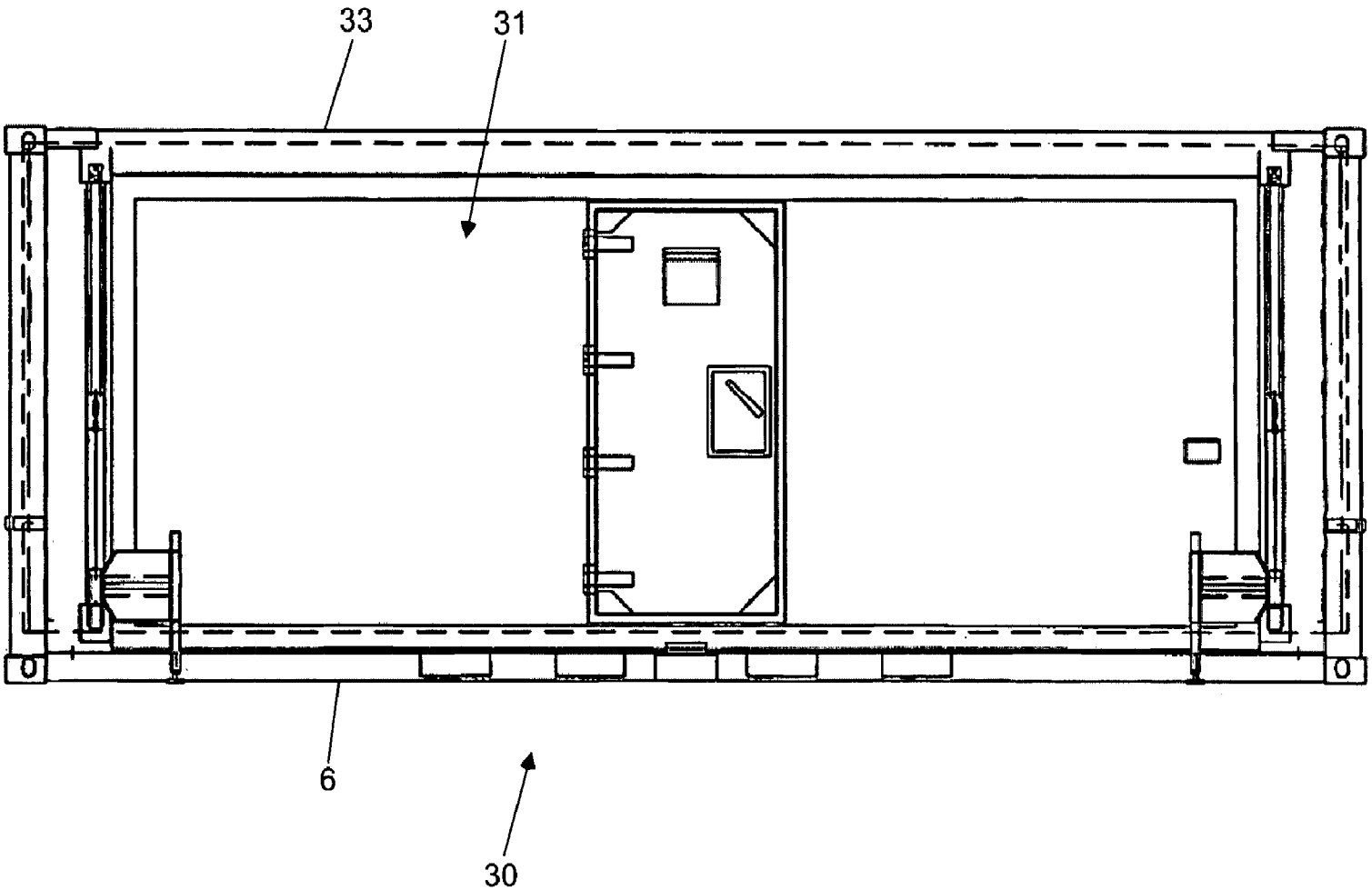
FIG. 27 is a front view of the exterior of the double-side expandable shelter system of the present invention arranged in its transport configuration without interior equipment mounted therein, and showing the front door of the shelter system arranged in its closed configuration.
Figure 28:
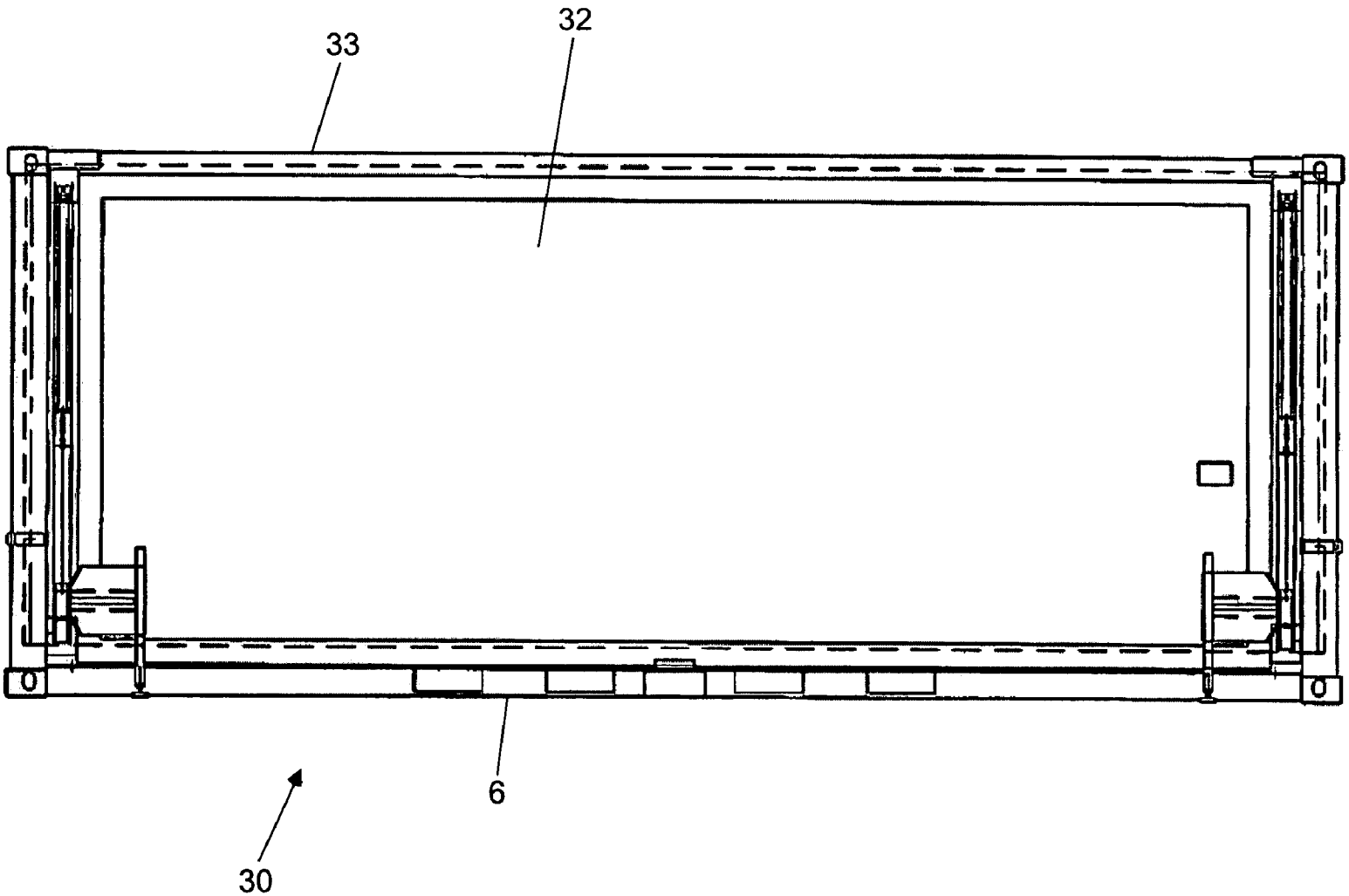
FIG. 28 is a rear view of the exterior of the double-side expandable shelter system of the present invention arranged in its transport configuration without interior equipment mounted therein, and showing the rear panel of the shelter system.
Figure 29:
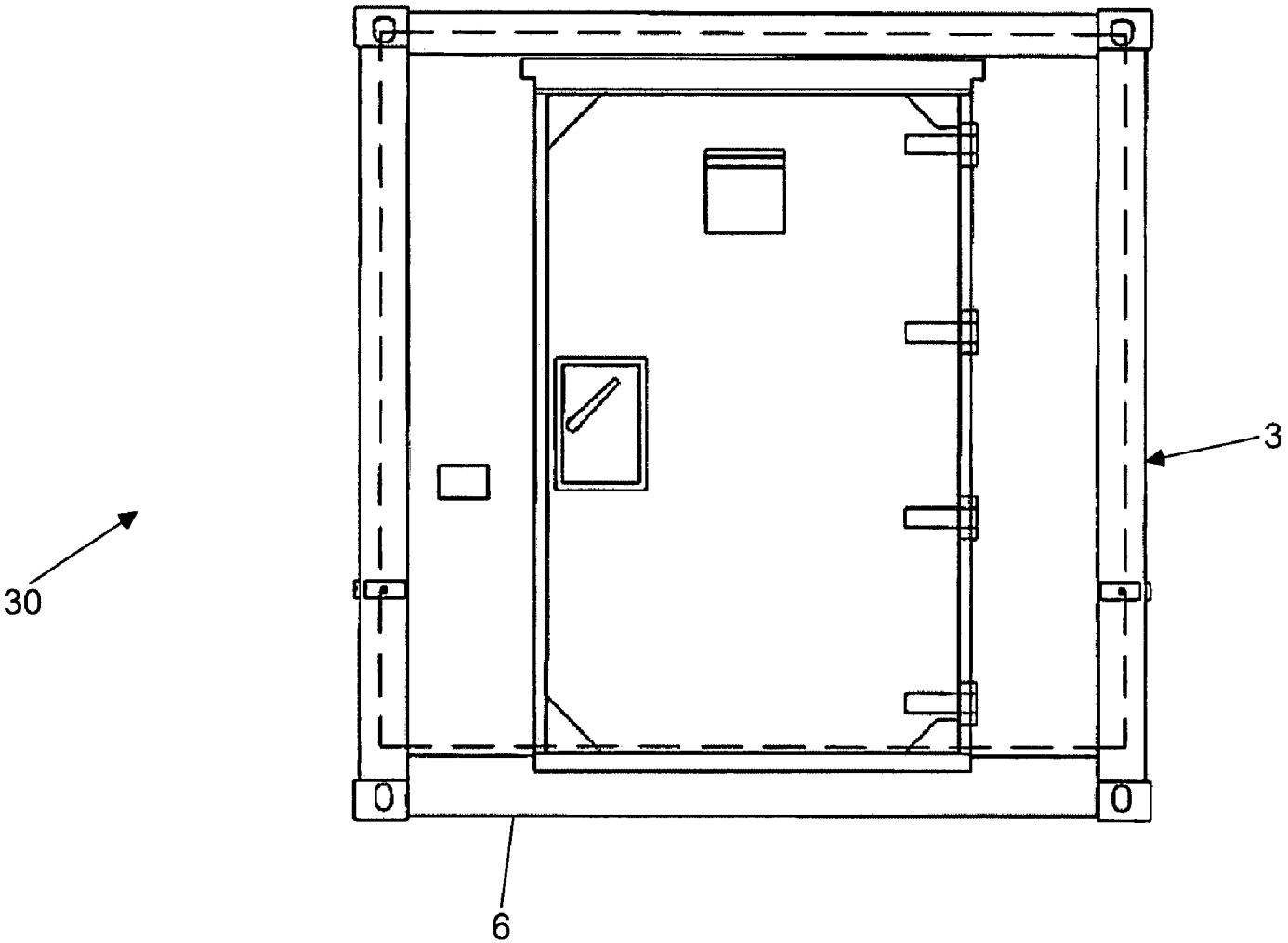
FIG. 29 is a side view of the exterior of the double-side expandable shelter system of the present invention arranged in its transport configuration without interior equipment mounted therein, and showing the side door of the shelter system arranged in its closed configuration.
Figure 30:
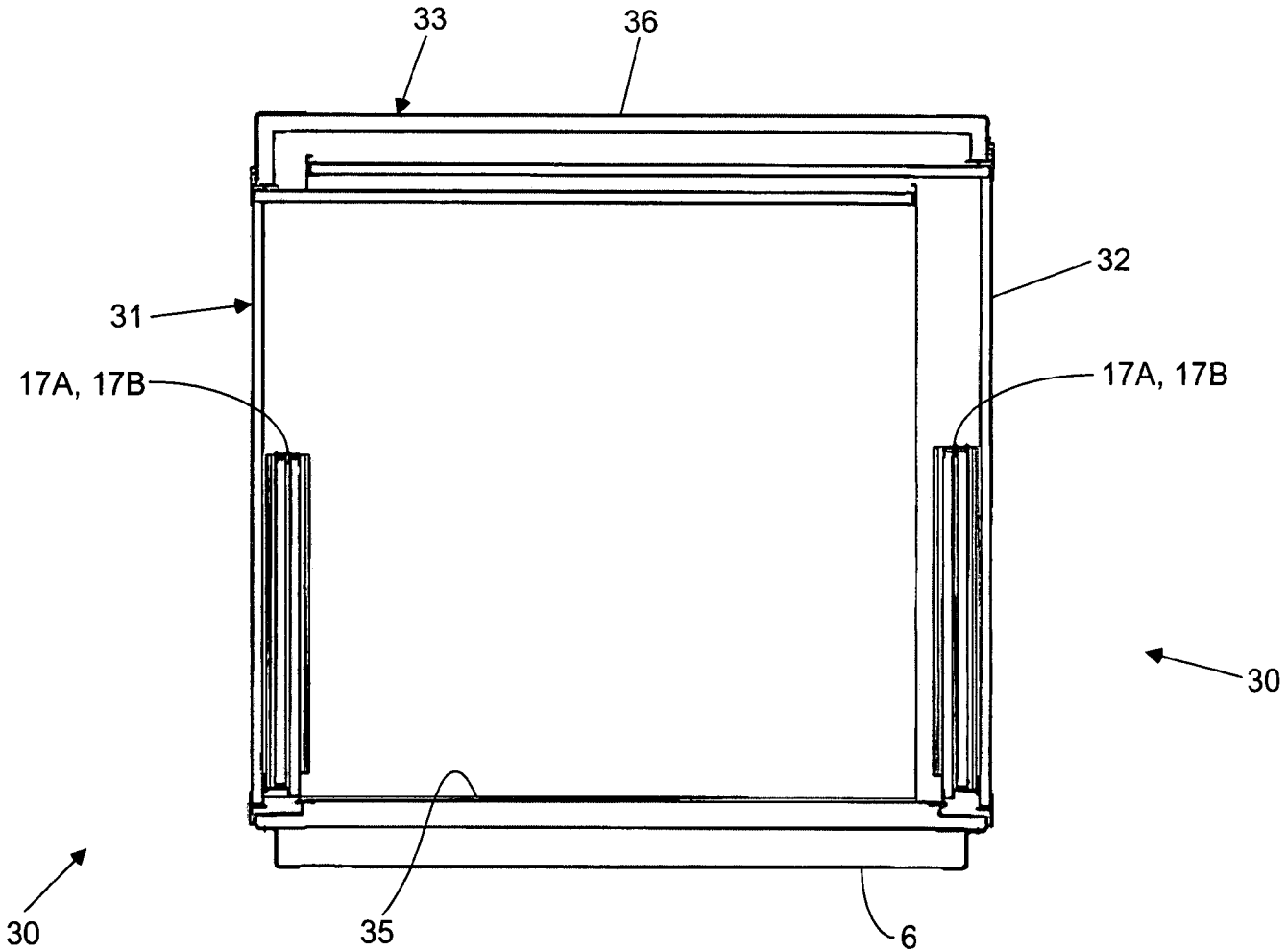
FIG. 30 is a sectional view of the double-side expandable shelter system of the present invention arranged in its transport configuration without interior equipment mounted therein, and showing both the hinged floor panels folded up and vertically arranged against the front and rear panels of the shelter system while the first and second expandable sections are nested within the main section of the shelter system.
Figure 31A:
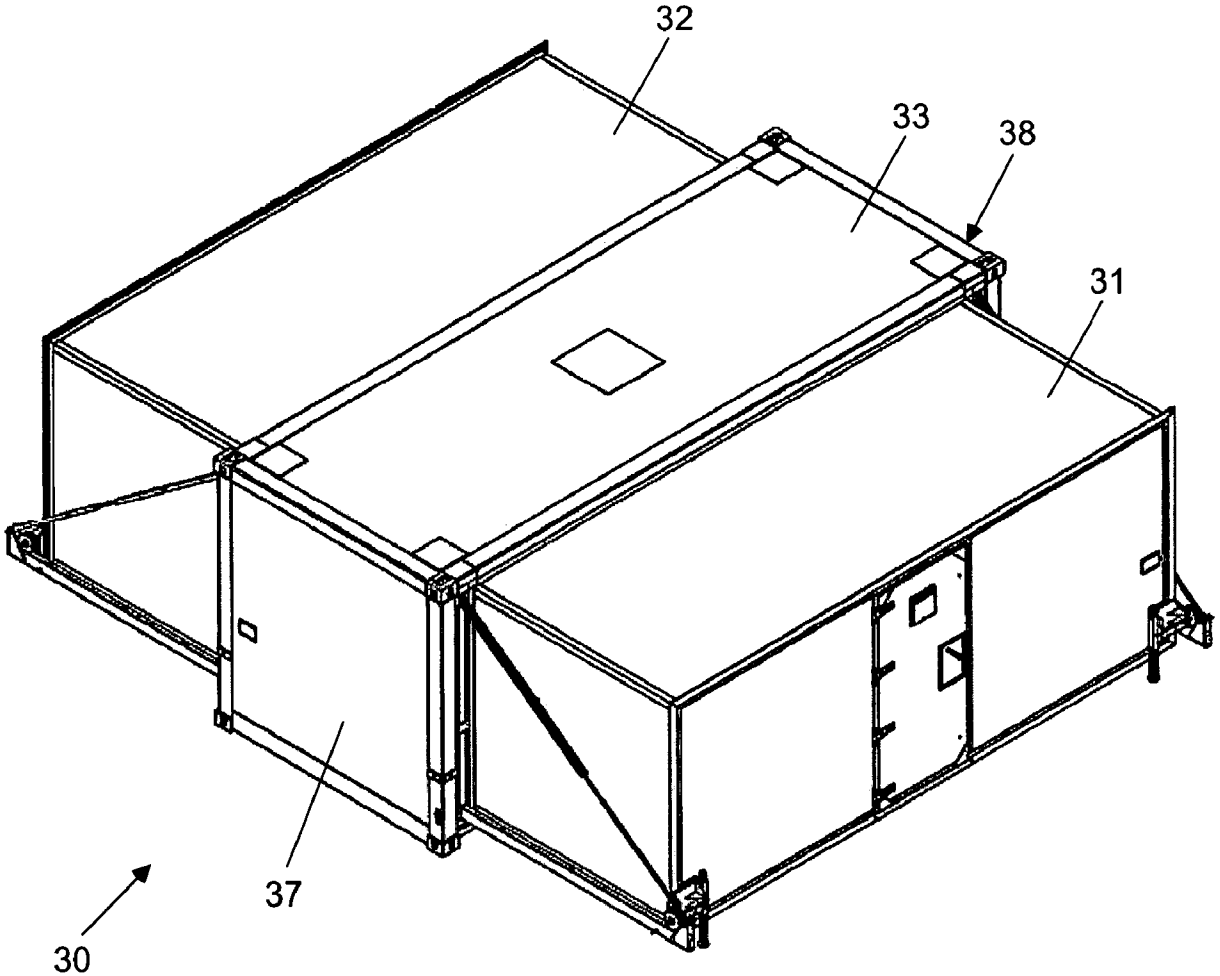
FIG. 31A is a first perspective view of the double-side expandable shelter system of the present invention arranged in its deployment configuration/mode, without interior equipment mounted therein, and showing both of its double expandable sections fully projected out from within the interior volume of the main shelter section.
Figure 31B:
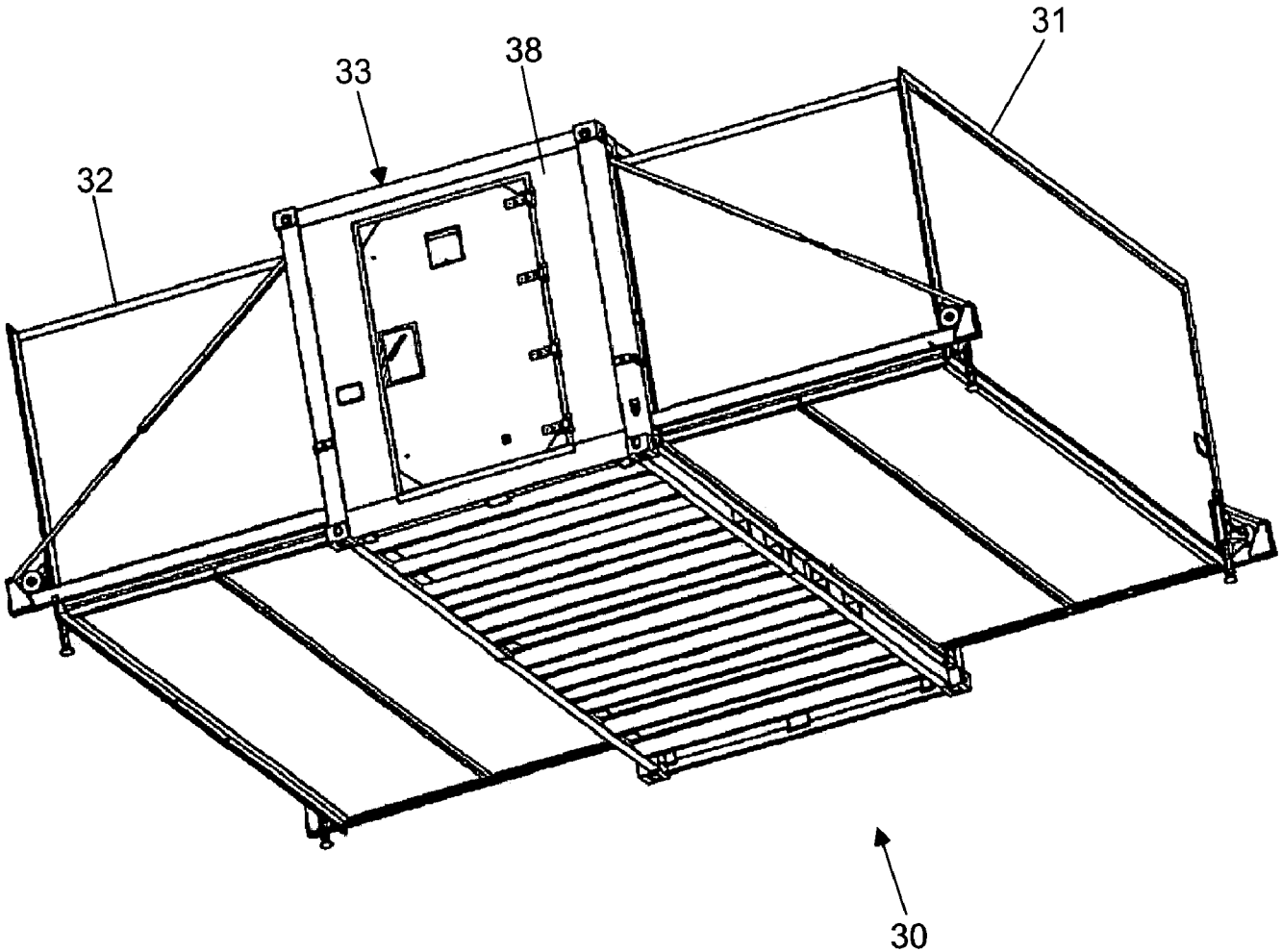
FIG. 31B is a second perspective view of the double-side expandable shelter system of the present invention arranged in its deployment configuration/mode, without interior equipment mounted therein, and showing both of its double expandable sections fully projected out from within the interior volume of the main shelter section.
Figure 32:
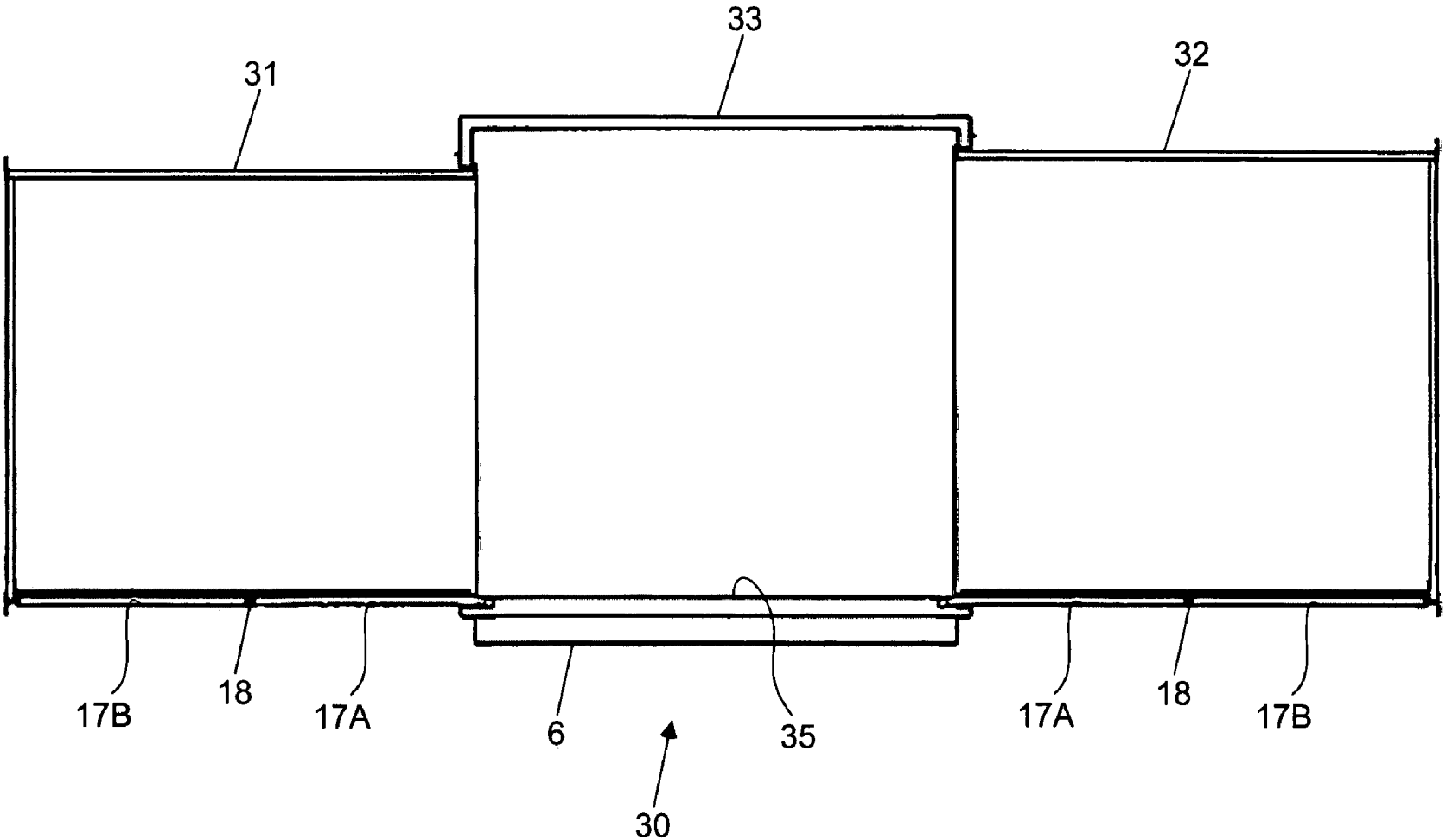
FIG. 32 is a sectional view of the double-side expandable shelter system of the present invention arranged in its full deployment mode/configuration without interior equipment mounted therein, and showing both the hinged floor panels horizontally extended within a horizontal plane of the shelter system while the first and second expandable sections are fully extended out of the main section of the shelter system.
Figure 33:
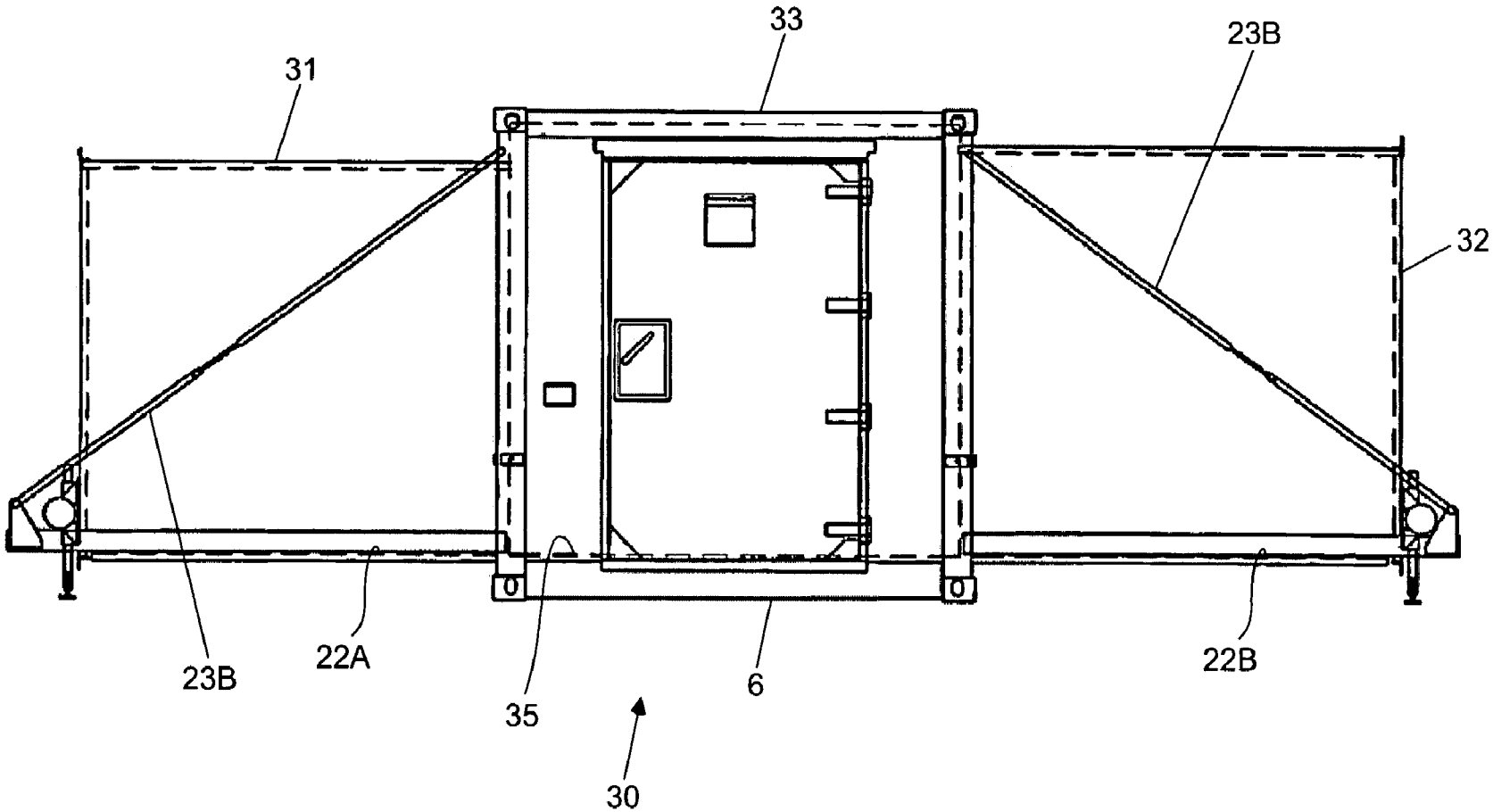
FIG. 33 is a first side view of the double-side expandable shelter system of the present invention arranged in its full deployment mode/configuration without interior equipment mounted therein, and showing both the hinged floor panels horizontally extended within a horizontal plane of the shelter system while the first and second expandable sections are fully extended out of the main section of the shelter system.
Figure 34:
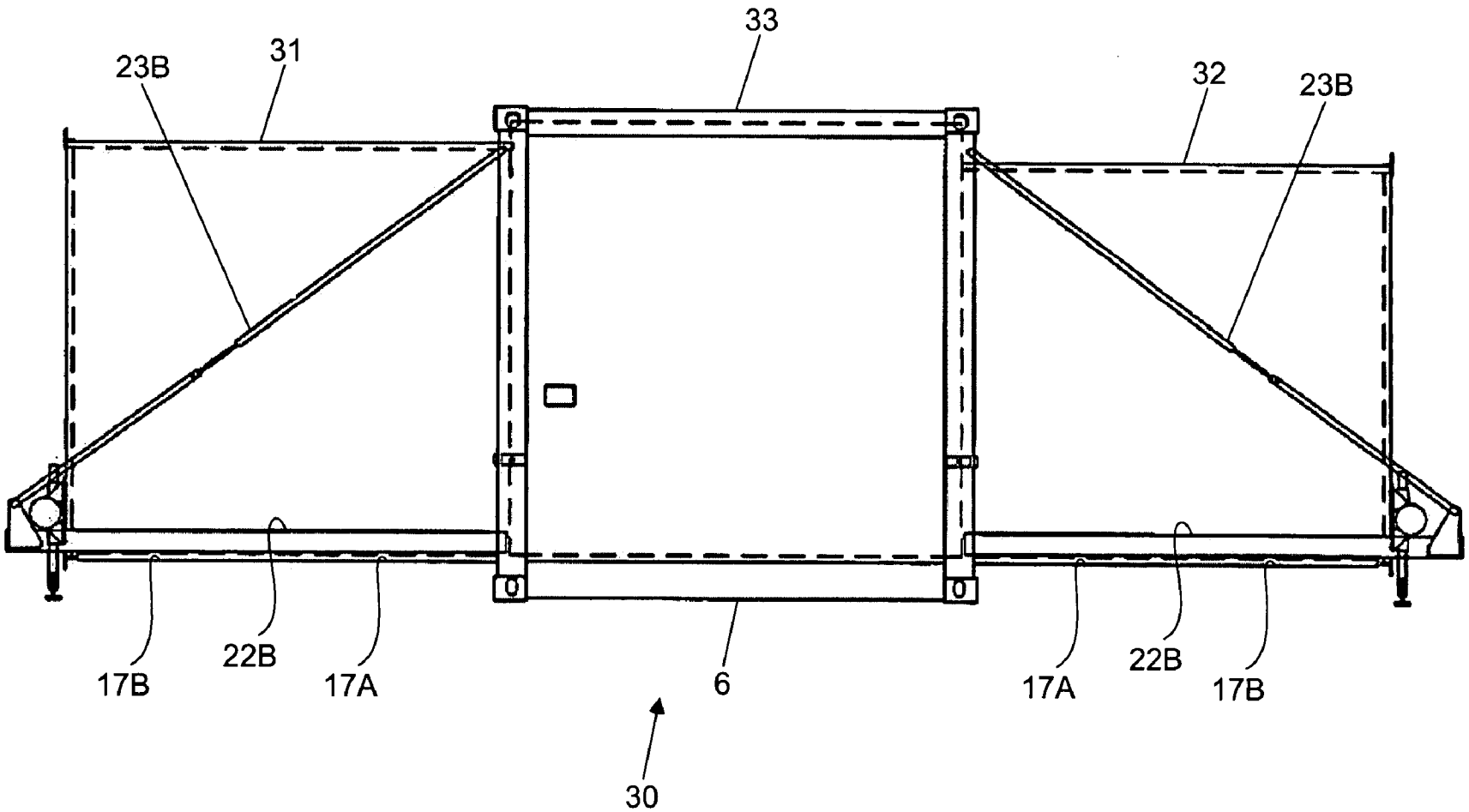
FIG. 34 is a second side view of the double-side expandable shelter system of the present invention arranged in its full deployment mode/configuration without interior equipment mounted therein, and showing both the hinged floor panels horizontally extended within a horizontal plane of the shelter system while the first and second expandable sections are fully extended out of the main section of the shelter system.
Figure 35:
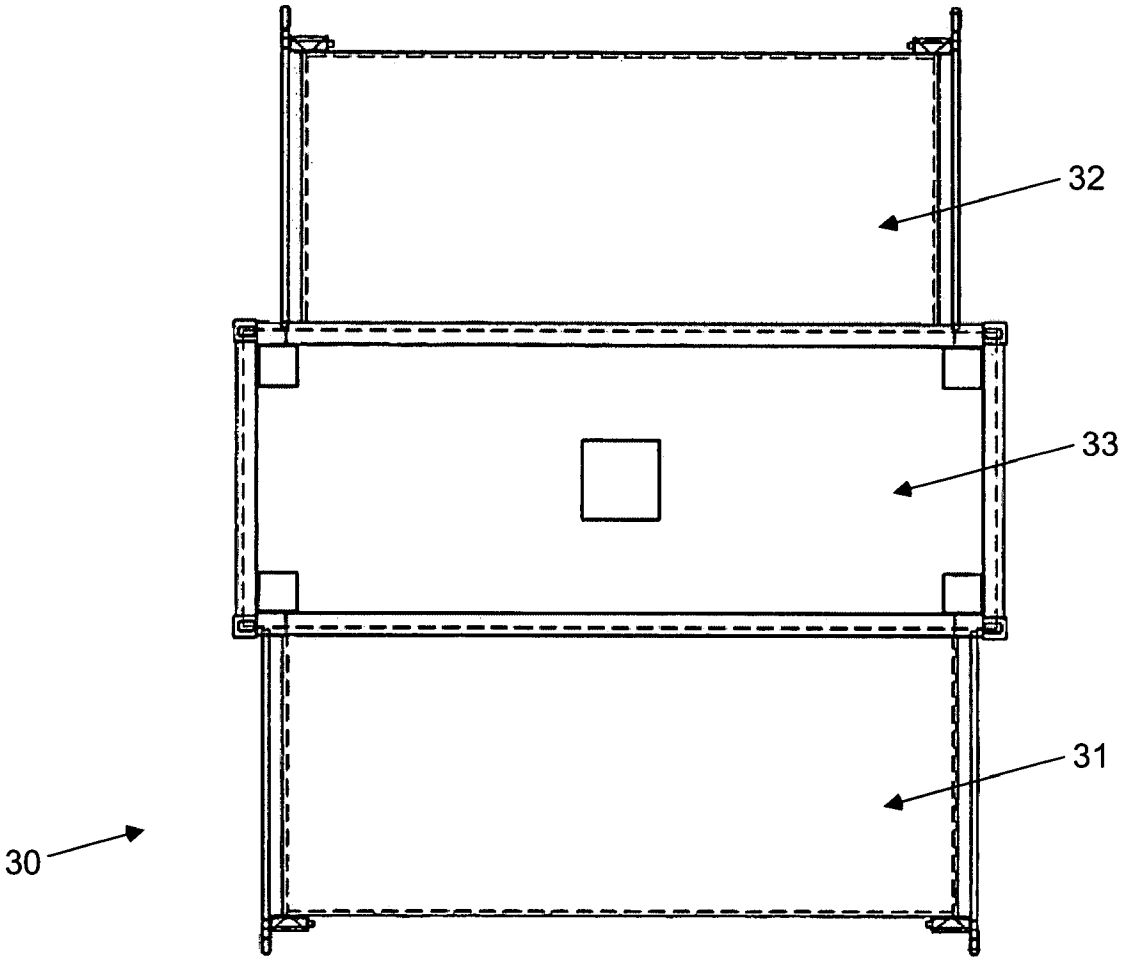
FIG. 35 is a plan view of the double-side expandable shelter system of the present invention arranged in its full deployment mode/configuration without interior equipment mounted therein, and showing both the first and second expandable sections being fully extended out of the main section of the shelter system, providing a 3:1 expansion in volume of the main shelter section when the system is configured in its deployment mode.

In FIGS. 26 and 30, the double-side expandable shelter system of the present invention, constructed in accordance with ISO standards, 30 is shown arranged in its transport mode/configuration from different views, with its expandable sections 31 and 32 are nested inside the main shelter section 33. As shown, the double side expandable shelter system 30 comprises: (1) main shelter section 3B having (i) a floor structure 35, beneath which a replaceable full-length skid structure is affixed thereto, (ii) a top panel 36, and (iii) first and second side panels 37 and 38, interconnected within a framework constructed from frame members described in connection with the single-side expandable shelter system, in a conventional manner in accordance with ISO standards, to form a four-sided box-line container with two opposing openings along its length dimension; (2) a pair of four-sided expandable sections 31 and 32, each having a front wall panel, a top panel, and first and second side panels, and a foldable flooring assembly including first and second flooring sections 7A and 7B that hinge together, as described above; and (3) a pair of side expandable section support mechanisms 21A and 21B, for supporting first and second side expandable sections 31 and 32, respectively, during the deployment mode of operation.

In FIGS. 31A through 35, the shelter system is shown configured in its deployment/operating mode. During this configuration process, the each side expandable section support mechanism 21A, 21B is pulled down into its operating configuration with horizontal support members 22A, 22B resting slightly above the ground surface. During the deployment process, the foldable flooring assembly 7 unfolds and assumes its horizontal position, while being supported along its outer edges by support flanges provided along the perimeter of side wall panels 7A and 7B and front wall panel of the side expandable section 31, 33 during the final phase of the deployment mode. After each side section is slid out from the main shelter section, the diagonal and horizontal support members support the load provided by expandable side sections 31 and 32.

In FIGS. 15 through 35, the expandable shelter system is shown without any interior equipment mounted within the expandable shelter system in order to help illustrate the construction of the system, and illustrate the simplicity and elegance of this inventive design. However, in view of FIGS. 20A through 24, the benefits and advantages gained by the design of the present invention are clear. Equipment of various kinds (e.g. electronic equipment and rack and cabinet structures) 25 can be permanently mounted on both the interior wall surfaces of the side expandable sections 31 and 32 above the height of the foldable flooring assemblies, and on the flooring structure of main shelter section.

Figure 36:
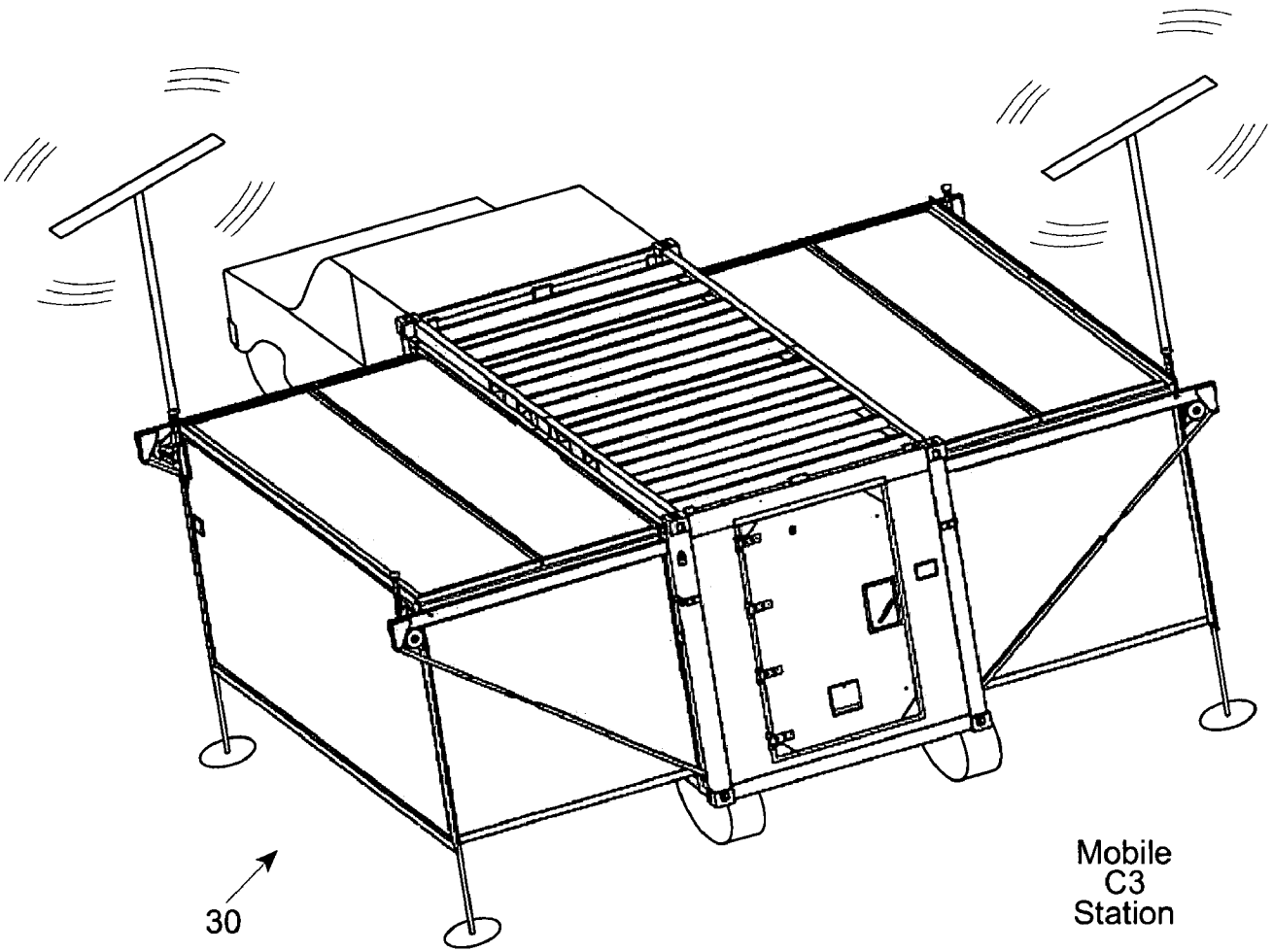
FIG. 36 is a perspective view of the double-side expandable shelter system of the present invention arranged in its full deployment mode/configuration, while supported on a mobile carrier vehicle.

As shown in FIG. 36, either the single or double side expandable shelter systems of the present invention can be arranged in their full deployment mode/configuration, while supported on a mobile carrier vehicle, as well as on the ground.

Figure 37:
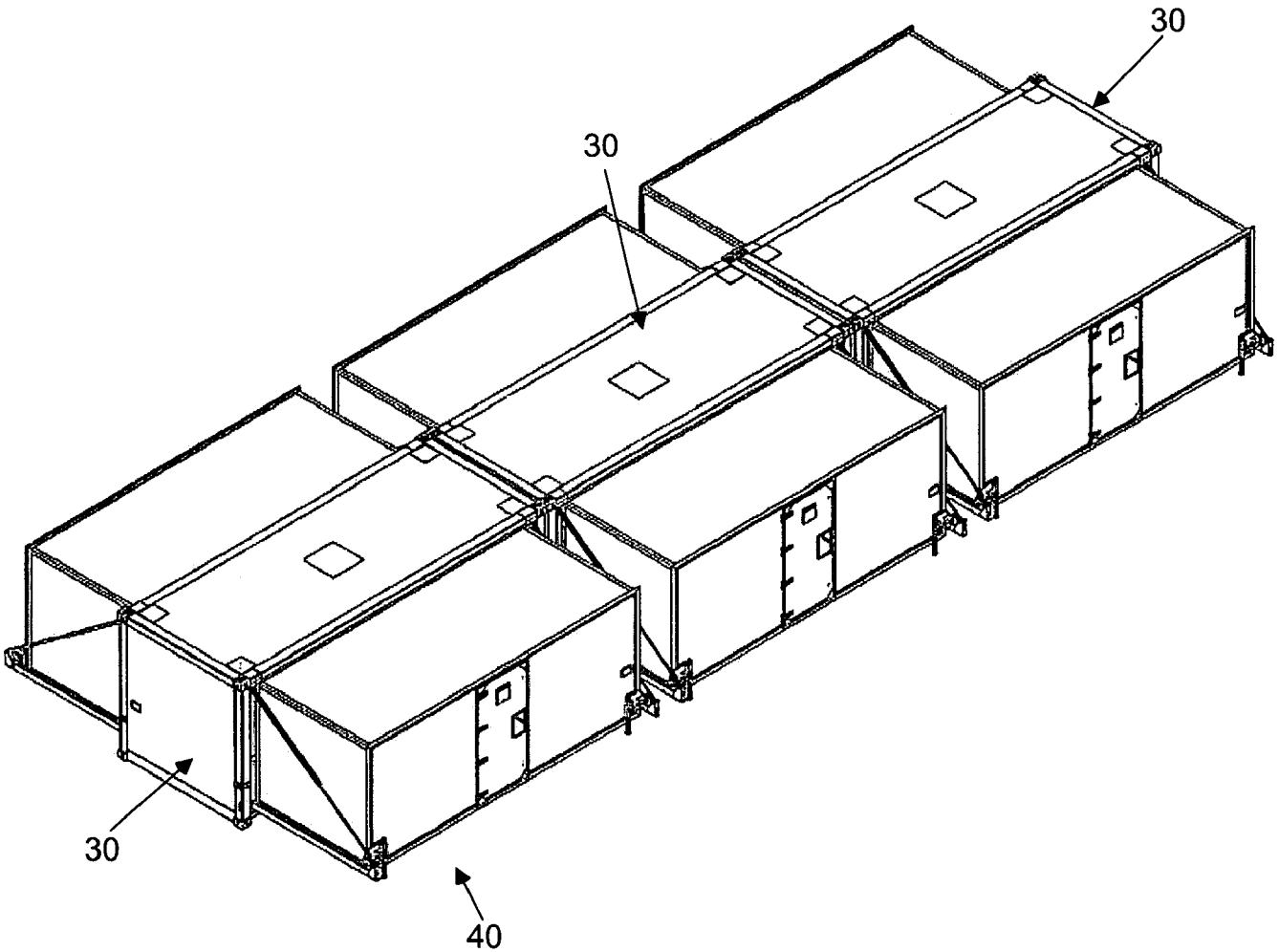
FIG. 37 is a perspective view of a plurality of double-side and single-side expandable shelter systems of the present invention docked together to form a larger functioning unit for use in diverse field applications.

Also, as shown in FIG. 37, a plurality of single and/or double side expandable shelter systems of the present invention can be simply docked together to form a larger functioning unit 40, such as a command center, or medical hospital, for use in diverse field applications. Such inter-shelter docking operations can be achieved directly between door ports, and/or using flexible sluice (conduit-type) subsystems well known in the art.

While the wall panels of the expandable shelter system described above are preferably constructed by (i) welding vertical reinforcement members to sheets of aluminum, (ii) then placing insulating foam sheets between these members, and (iii) finally bonding a second sheet of aluminum thereto using epoxy adhesive, pressure and spot welding techniques—to form strong, yet very lightweight wall panels for constructing shelter wall sections—, it is understood that other alternative techniques may be used with excellent results in particular applications. Similarly, while the flooring structure of the main/central shelter section, as well the foldable flooring panels used in the side expandable section, are preferably made by welding aluminum frame members together using a reinforced architecture, then sandwiching such frame structures and insulating foam between sheet of aluminum, and bonding and welding the same using epoxy adhesive and spot welding techniques, other alternative methods of construction may also be used with excellent results in particular applications.

It is understood that the expandable shelter systems of the illustrative embodiments may be modified in a variety of ways which will become readily apparent to those skilled in the art of the present invention and having the benefit of the novel teachings disclosed herein. All such modifications and variations of the illustrative embodiments thereof shall be deemed to be within the scope and spirit of the present invention as defined by the Claims to Invention appended hereto.

What is claimed is:

1. A single-side expandable shelter system having a transport mode in which a side expandable shelter section is completely nested within a main shelter section having a main floor surface, and a deployment mode in which said side expandable section is completely protracted from said main shelter section, said single-side expandable shelter system comprising:

a side flooring structure with a side floor surface provided by a hinged flooring panel assembly comprising at least first and second floor panels hinged together for stacking compactly in a vertically elongated direction when said side expandable shelter section is retracted within said main shelter section, in a nested manner, so as to be completely contained therewithin during said transport mode;

wherein said side expandable section includes a front wall panel, a top panel, and first and second side panels, fixedly arranged with respect to each other, and said foldable flooring assembly;

wherein said first and second floor panels are hinged together at a point and also with the bottom of said front wall panel and the edge of the main floor structure of said main shelter section; and wherein said main floor surface and said side floor surface are disposed in substantially the same plane during said deployment mode.

2. The single-side expandable shelter system of claim 1, wherein equipment is permanently mounted on said main floor surface of said main shelter section; and wherein said side expandable shelter section has an interior volume that is substantially the same as the interior volume of said main shelter section, thereby maximizing the total utilizable volume of said single-side expandable shelter system during said deployment mode.

3. The single-side expandable shelter system of claim 1, wherein equipment is permanently mounted to the upper half of the three side panels of said expandable shelter section, thereby allowing for permanent interconnection of said equipment.

4. The single-side expandable shelter system of claim 1, which further comprises a side expandable section support mechanism for supporting said side expandable shelter section during said deployment mode.

5. A double side expandable shelter system comprising:

a main shelter section having a main floor structure with a main floor surface;

a first side expandable shelter section having (i) a first front wall panel, a first top panel and first side panels fixedly arranged with respect to each other and (ii) a first flooring structure with a first side floor surface provided by a first hinged flooring panel assembly including at least first and second floor panels hinged together and operably connected between said main shelter section and said side expandable shelter section;

a second side expandable shelter section having (i) a second front wall panel, a second top panel and second side panels fixedly arranged with respect to each other, and (ii) a second flooring structure with a second side floor surface provided by a second hinged flooring panel assembly including at least third and fourth floor panels hinged together and operably connected between said main shelter section and said side expandable shelter section;

a transport mode in which said first and second side expandable shelter sections are completely nested within said main shelter section; and a deployment mode in which said first and second side expandable shelter sections are completely protracted from said main shelter section;

wherein said first hinged flooring panel assembly is folded in a vertical manner when said first side expandable shelter section is retracted within said main shelter section, in a nested manner, so as to be completely contained therewithin during said transport mode;

wherein said second hinged flooring panel assembly is folded in a vertical manner when said second side expandable shelter section is retracted within said main shelter section, in a nested manner, as to be completely contained therewithin during said transport mode;

wherein said first hinged flooring panel assembly can be unfolded and arranged in a horizontal direction when said first side expandable shelter section is protracted from said main shelter section during said deployment mode;

wherein said second hinged flooring panel assembly can be unfolded and arranged in a horizontal direction when said second side expandable shelter section is protracted from said main shelter section during said deployment mode;

wherein said first and second floor panels are hinged together at a point and with the bottom of said front wall panel and to the edge of the floor structure of said main shelter section; and wherein said main floor surface and said first and second side floor surfaces are disposed in substantially the same plane during said deployment mode.

6. A single-side expandable shelter system comprising:

a main shelter section having a main floor surface;

a side expandable shelter section having a flooring structure with a side floor surface provided by a hinged flooring panel assembly including at least first and second floor panels hinged together and operably connected between said main shelter section and said side expandable shelter section;

a transport mode in which said side expandable shelter section is completely nested within said main shelter section; and a deployment mode in which said side expandable shelter section is completely protracted from said main shelter section, and where said main floor surface and said side floor surface are disposed in substantially the same plane during said deployment mode;

wherein said at least first and second floor panels are stacked compactly in a vertical direction when said side expandable shelter section is retracted within said main shelter section, in a nested manner, so as to be completely contained therewithin during said transport mode; and wherein said at least first and second floor panels are unfolded and arranged in a horizontal direction when said side expandable shelter section is protracted from said main shelter section during said deployment mode;

wherein said side expandable shelter section comprises a front wall panel, a top panel, and first and second side panels fixedly arranged with respect to each other, and said hinged flooring panel assembly, and wherein said at least first and second floor panels are hinged together at a point and with the bottom of said front wall panel and the edge of said floor surface of said main shelter section.

7. The single-side expandable shelter system of claim 6, wherein equipment can be permanently mounted on said floor structure of said main shelter section; and said expandable shelter side section has an interior volume that is substantially the same as the interior volume of said main shelter section, thereby maximizing the total utilizable volume of said single side expandable shelter system in said deployment mode.

8. The single-side expandable shelter system of claim 6, wherein equipment is permanently mounted to the upper half of the three side panels in said side expandable shelter section, thereby allowing for permanent interconnection of said equipment.

9. The single-side expandable shelter system of claim 6, which further comprises a side expandable section support mechanism for supporting said side expandable section during said deployment mode.

10. A plurality of single or double side expandable shelter systems of claim 6, 1 or 5 docked together to form a larger functioning unit, such as a command center, or medical hospital, for use in diverse field applications.

11. A command, control and communications (C3) systems comprising said expandable shelter system of claim 6, 1 or 5.

12. A medical station comprising said expandable shelter system of claim 6, 1 or 5.

13. A single-side expandable shelter system comprising:

a main shelter section having a main floor surface;

a side expandable shelter section having (i) side and top panels fixedly arranged with respect to each other, and (ii) a flooring structure with a side floor surface provided by a hinged flooring panel assembly including at least two floor panels hinged together and operably connected between said main shelter section and said side expandable shelter section;

a transport mode in which said side expandable shelter section is completely nested within said main shelter section; and a deployment mode in which said side expandable shelter section is completely protracted from said main shelter section;

wherein said at least two floor panels are stacked compactly in a vertical direction when said side expandable shelter section is retracted within said main shelter section, in a nested manner, so as to be completely contained therewithin during said transport mode; and wherein said at least two floor panels are unfolded and arranged in a horizontal direction when said side expandable shelter section is protracted from said main shelter section during said deployment mode;

wherein said main shelter section includes (i) a main floor structure supporting said main floor surface, beneath which a replaceable full-length skid structure is affixed thereto, (ii) a top panel, a front panel with a front door having open and closed configurations, and (iii) first and second side panels interconnected within a framework constructed from a frame member and being fixedly arranged with respect to each other, so as to form a five-sided box container with an open side along its length dimension;

wherein said main floor surface and said side floor surface are disposed in substantially the same plane during said deployment mode.

14. A single-side expandable shelter system comprising:

a main shelter section having a main floor section with a main floor surface;

a side expandable shelter section having (i) side and top panels fixedly arranged with respect to each other, and (ii) a flooring structure with a side floor surface provided by a hinged flooring panel assembly including at least first and second floor panels hinged together and operably connected between said main shelter section and said side expandable shelter section;

a transport mode in which said side expandable shelter section is completely nested within said main shelter section; and a deployment mode in which said side expandable shelter section is completely protracted from said main shelter section and where said main floor surface and said side floor surface are disposed in substantially the same plane during said deployment mode;

a side expandable section support mechanism for supporting said side expandable shelter section during said deployment mode;

wherein said at least first and second floor panels are stacked compactly in a vertical direction when said side expandable shelter section is retracted within said main shelter section, in a nested manner, so as to be completely contained therewithin during said transport mode; and wherein said at least first and second floor panels are unfolded and arranged in a horizontal direction when said side expandable shelter section is protracted from said main shelter section during said deployment mode;

wherein said side expandable section support mechanism includes a pair of hinged horizontally-extending expansion section support members that are hingedly connected at one end to the bottom exterior of said main shelter section, and to their other ends by a pair of diagonally-extending support members connected to the top portion of said main shelter section.

15. A double side expandable shelter system comprising:

a main shelter section;

a first side expandable shelter section having side and top panels fixedly arranged with respect to each other, and a first flooring structure with a first side floor surface provided by a first hinged flooring panel assembly including at least first and second floor panels hinged together and operably connected between said main shelter section and said side expandable shelter section;

a second side expandable shelter section having side and top panels fixedly arranged with respect to each other, and a second flooring structure with a second side floor surface provided by a second hinged flooring panel assembly including at least second and third floor panels hinged together and operably connected between said main shelter section and said side expandable shelter section;

a transport mode in which said side expandable shelter sections are completely nested within said main shelter section; and a deployment mode in which said side expandable shelter sections are completely protracted from said main shelter section;

wherein said first hinged flooring panel assembly is folded in a vertical manner when said first side expandable shelter section is retracted within said main shelter section, in a nested manner, as to be completed contained therewithin during said transport mode;

wherein said second hinged flooring panel assembly is folded in a vertical manner when said second side expandable shelter section is retracted within said main shelter section, in a nested manner,so as to be completely contained therewithin during said transport mode;

wherein said first hinged flooring panel assembly can be unfolded and arranged in a horizontal direction when said first side expandable shelter section is protracted from said main shelter section during said deployment mode;

wherein said second hinged flooring panel assembly can be unfolded and arranged in a horizontal direction when said second side expandable shelter section is protracted from said main shelter section during said deployment mode; and wherein said main shelter section has (i) a main floor structure with a main floor surface, beneath which a replaceable full-length skid structure is affixed thereto, (ii) a top panel, a front panel with a front door having open and closed configurations, and (iii) first and second side panels interconnected within a framework constructed from frame member and being fixedly arranged with respect to said top and front panels, so as to form a five-sided box container with an open side along its length dimension; and wherein said main floor surface and said first and second side floor surfaces are disposed in substantially the same plane during said deployment mode.

16. The double side expandable shelter system of claim 15, wherein equipment is permanently mounted on said main floor sfurface of said main shelter section; and said first and second side expandable shelter sections each have an interior volume that is substantially the same as the interior volume of said main shelter section, thereby maximizing the total utilizable volume of said double side expandable shelter system in said deployment mode.

17. The double side expandable shelter system of claim 15, wherein equipment is permanently mounted to the upper half of the three side walls of at least one of said first and second side expandable shelter sections, thereby allowing for permanent interconnection of said equipment.

18. A single-side expandable shelter system having a transport mode in which a side expandable section is completely nested within a main shelter section, and a deployment mode in which said side expandable section is completely protracted from said main shelter section, said single-side expandable shelter system comprising:

said side expandable section including side and top panels fixedly arranged with respect to each other, and a side flooring structure with a side floor surface provided by a hinged flooring panel assembly including at least first and second floor panels hinged together for stacking compactly in a vertically elongated direction when said side expandable section is retracted within said main shelter section, in a nested manner, so as to be completely contained therewithin during said transport mode; and wherein said main shelter section including (i) a main floor structure having a main floor surface, beneath which a replaceable full-length skid structure is affixed to said main floor structure, (ii) a top panel, a front panel with a front door having open and closed configurations, and (iii) first and second side panels interconnected within a framework constructed from a frame member and fixedly arranged with respect to said top and front panels, so as to form a five-sided box container with an open side along its length dimension; and wherein said main floor surface and said side floor surface are disposed in substantially the same plane during said deployment mode.

19. A single-side expandable shelter system having a transport mode in which a side expandable section is completely nested within a main shelter section with a main floor surface, and a deployment mode in which said side expandable section is completely protracted from said main shelter section, said single-side expandable shelter system comprising:

side and top panels fixedly arranged with respect to each other; and a flooring structure with a side floor surface provided by a hinged flooring panel assembly including at least two floor panels hinged together for stacking compactly in a vertically elongated direction when said side expandable section is retracted within said main shelter section, in a nested manner, so as to be completely contained therewithin during said transport mode; and a side expandable section support mechanism for supporting said side expandable section during said deployment mode;

wherein said side expandable section support mechanism includes a pair of hinged horizontally-extending expansion section support members that are hingedly connected at one end to the bottom exterior of said main shelter section, and to their other ends by a pair of diagonally-extending support members connected to the top portion of said main shelter section; and wherein said main floor surface and said side floor surface are disposed in substantially the same plane during said deployment mode.

20. A double side expandable shelter system comprising:

a main shelter section with a main floor surface;

a first side expandable shelter section having (i) a first front wall panel, a first top panel and first side panels fixedly arranged with respect to each other, and (ii) a first flooring structure with a first side floor surface provided by a first hinged flooring panel assembly including at least first and second floor panels hinged together and operably connected between said main shelter section and said side expandable shelter section;

a second side expandable shelter section having (i) a second front wall panel, a second top panel and second side panels fixedly arranged with respect to each other, and (ii) a second flooring structure with a second side floor surface provided by a second hinged flooring panel assembly including at least third and fourth floor panels hinged together and operably connected between said main shelter section and said second side expandable shelter section;

a transport mode in which said side expandable shelter sections are completely nested within said main shelter section; and a deployment mode in which said side expandable shelter sections are completely protracted from said main shelter section;

wherein said first hinged flooring panel assembly is folded in a vertical manner when said first side expandable shelter section is retracted within said main shelter section, in a nested manner, so as to be completely contained therewithin during said transport mode;

wherein said second hinged flooring panel assembly is folded in a vertical manner when said second side expandable shelter section is retracted within said main shelter section, in a nested manner, so as to be completely contained therewithin during said transport mode;

wherein said first hinged flooring panel assembly can be unfolded and arranged in a horizontal direction when said first side expandable shelter section is protracted from said main shelter section during said deployment mode;

wherein said second hinged flooring panel assembly can be unfolded and arranged in a horizontal direction when said second side expandable shelter section is protracted from said main shelter section during said deployment mode;

wherein said first and second floor panels are hinged together at a point and with the bottom of said front wall panel and the edge of the main floor structure of said main shelter section and wherein said main floor surface and said first and second side floor surfaces are disposed in substantially the same plane during said deployment mode.

21. The double expandable shelter system of claim 20, which further comprises: a first side expandable section support mechanism for supporting said first side expandable shelter section during said deployment mode; and a second side expandable section support mechanism for supporting said second side expandable shelter section during said deployment mode.

22. An expandable shelter system comprising:

a main shelter section having a floor structure with a main floor surface;

a side expandable shelter section having a flooring structure with a side floor surface provided by a hinged flooring panel assembly including at least first and second floor panels hinged together and operably connected between said main shelter section and said side expandable shelter section;

a transport mode in which said side expandable shelter section is substantially nested within said main shelter section; and a deployment mode in which said side expandable shelter section is substantially protracted from said main shelter section;

wherein said at least first and second floor panels are stacked compactly in a vertical direction when said side expandable shelter section is retracted within said main shelter section, in a nested manner, so as to be substantially contained therewithin during said transport mode; and wherein said at least first and second floor panels are unfolded and arranged in a horizontal direction when said side expandable shelter section is protracted from said main shelter section during said deployment mode;

wherein said side expandable shelter section comprises a front wall panel, a top panel, and first and second side panels fixedly arranged with respect to each other, and said hinged flooring panel assembly;

wherein said at least first and second floor panels are hinged together at a point and with the bottom of said front wall panel and to the edge of the main floor structure of said main shelter section; and wherein said main floor surface and said side floor surface are disposed in substantially the same plane during said deployment mode.

23. The expandable shelter system of claim 22, wherein equipment is mounted on said floor structure of said main shelter section; and wherein said side expandable shelter section has an interior volume that is substantially the same as the interior volume of said main shelter section, thereby maximizing the total utilizable volume of said expandable shelter system in said deployment mode.

24. The expandable shelter system of claim 22, wherein equipment is mounted to the upper half of the three side panels of said side expandable shelter section, thereby allowing for interconnection of said equipment.

25. The expandable shelter system of claim 22, which further comprises a side expandable section support mechanism for supporting said side expandable shelter section during said deployment mode.

* * * * *